US009627128B2

(12) United States Patent
Saito et al.

(10) Patent No.: US 9,627,128 B2
(45) Date of Patent: Apr. 18, 2017

(54) ANTENNA MODULE, COMMUNICATION DEVICE AND METHOD OF MANUFACTURING ANTENNA MODULE

(75) Inventors: Norio Saito, Tochigi (JP); Katsuhisa Orihara, Tochigi (JP); Yoshito Ikeda, Tochigi (JP); Satoru Sugita, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 308 days.

(21) Appl. No.: 13/824,860

(22) PCT Filed: Dec. 28, 2011

(86) PCT No.: PCT/JP2011/080444

§ 371 (c)(1),
(2), (4) Date: Mar. 18, 2013

(87) PCT Pub. No.: WO2012/091108

PCT Pub. Date: Jul. 5, 2012

(65) Prior Publication Data

US 2013/0181805 A1 Jul. 18, 2013

(30) Foreign Application Priority Data

Dec. 28, 2010 (JP) ..... 2010-293402
Dec. 27, 2011 (JP) ..... 2011-286177

(51) Int. Cl.
*H01F 38/14* (2006.01)
*H01F 41/071* (2016.01)
(Continued)

(52) U.S. Cl.
CPC ..... *H01F 38/14* (2013.01); *H01F 41/071* (2016.01); *H01Q 1/2216* (2013.01); *H01Q 1/243* (2013.01);
(Continued)

(58) Field of Classification Search
CPC ..... H01F 38/14
(Continued)

(56) References Cited

U.S. PATENT DOCUMENTS 6,848,616 B2 * 2/2005 Tsirline ..... G06K 7/0008 235/432
7,183,987 B2 * 2/2007 Akiho ..... G06K 7/0008 343/742
2010/0302039 A1 * 12/2010 Goto ..... H01Q 7/00 340/572.7

FOREIGN PATENT DOCUMENTS

JP A-2004-248497 9/2004
JP A-2008-035464 2/2008
(Continued)

OTHER PUBLICATIONS

International Search Report issued in Application No. PCT/JP2011/080444; Dated Mar. 19, 2012 (With Translation).

*Primary Examiner* — Dameon E Levi
*Assistant Examiner* — Walter Davis
(74) *Attorney, Agent, or Firm* — Oliff PLC

(57) ABSTRACT

A communication device that, when incorporated in an electronic device, can reduce the size and the thickness of a housing of the electronic device while maintaining communication characteristics. The communication device includes an antenna coil that is arranged on a peripheral part of a housing surface facing a reader-writer of a mobile phone, a magnetic sheet that attracts the magnetic filed transmitted from the reader-writer to the antenna coil, and a communication processing unit that is driven by a current flowing through the antenna coil and communicates with the reader-writer. The magnetic sheet is arranged to be closer to reader-writer than the antenna coil in the central part, and the antenna coil is arranged to be closer to the reader-writer on the outer periphery side, and at least a part of the conductive
(Continued)

line of the antenna coil is superimposed in a direction orthogonal to a circuit board.

13 Claims, 34 Drawing Sheets

(51) Int. Cl.
*H01Q 1/22* (2006.01)
*H01Q 7/00* (2006.01)
*H01Q 7/08* (2006.01)
*H01Q 1/24* (2006.01)

(52) U.S. Cl.
CPC ..... *H01Q 7/00* (2013.01); *H01Q 7/08* (2013.01); *Y10T 29/49018* (2015.01)

(58) Field of Classification Search
USPC ..... 343/788; 336/84
See application file for complete search history.

(56) References Cited

FOREIGN PATENT DOCUMENTS

| | | |
|---|---|---|
| JP | A-2010-245776 | 10/2010 |
| JP | A-2010-268306 | 11/2010 |

* cited by examiner

FIG. 42A
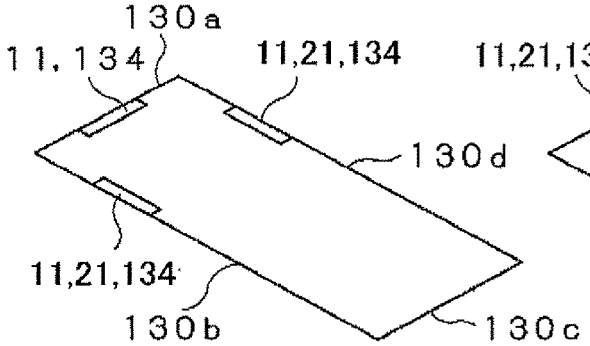
FIG. 42B
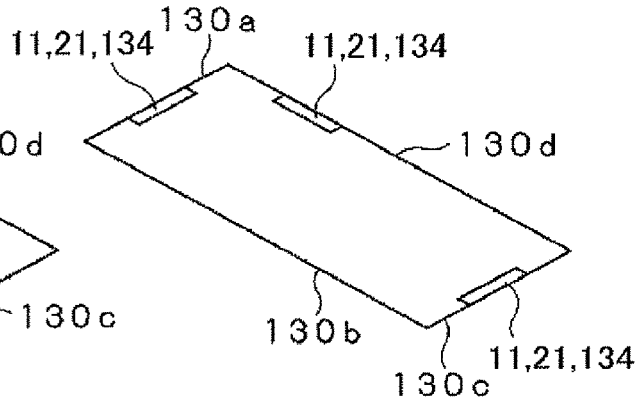
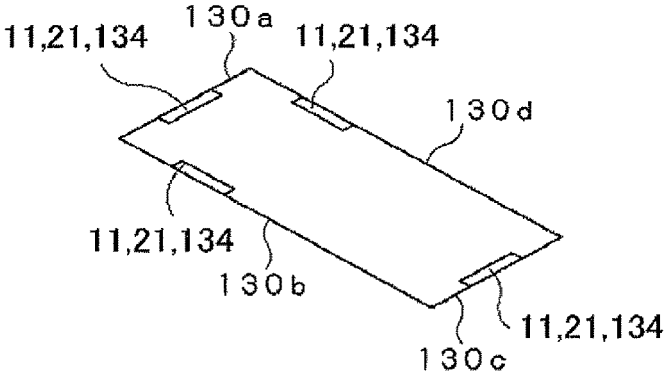
FIG. 43

ANTENNA MODULE, COMMUNICATION DEVICE AND METHOD OF MANUFACTURING ANTENNA MODULE

FIELD OF THE INVENTION

The present invention relates to an antenna module that is incorporated in an electronic device and becomes communicable in response to a magnetic field transmitted from a transmitter, a communication device and a method of manufacturing an antenna module.

The present application asserts priority rights based on JP Patent Application No. 2010-293402 filed in Japan on Dec. 28, 2010 and JP Patent Application No. 2011-286177 filed in Japan on Nov. 27, 2011. The total contents of disclosure of the patent application of the senior filing date are to be incorporated by reference into the present application.

BACKGROUND OF THE INVENTION

In an electronic device such as a mobile phone, in order to mount a function of noncontact short distance communication, an antenna module for RFID (Radio Frequency Identification) is used.

The antenna module communicates with an antenna coil mounted on a transmitter such as a reader-writer by using electromagnetic coupling. More specifically, the antenna module can drive an IC functioning a communication processing unit that causes the antenna coil to receive a magnetic field from the reader-writer to convert the magnetic field into electric power.

In the antenna module, magnetic fluxes having a certain value or more and transmitted from a reader-writer must be received by an antenna coil to reliably perform communication. In a conventional antenna module, a loop coil is arranged in the housing of a mobile phone, and the loop coil receives magnetic fluxes from a reader-writer.

However, in an antenna module incorporated in an electronic device such as a mobile phone, since a metal of a circuit board in the device or a battery pack reflects a magnetic fluxes from a reader-writer due to an eddy current generated by receiving a magnetic field from the reader-writer, the magnetic fluxes reaching the loop coil decrease. Since the magnetic fluxes reaching the loop coil decrease, the antenna module requires a loop coil having a certain opening area to collect required magnetic fluxes. Furthermore, the magnetic fluxes must be increased by using a magnetic sheet.

As described above, although magnetic fluxes from the reader-writer are reflected by an eddy current flowing in the circuit board of an electronic device such as a mobile phone, a component of a magnetic field along a plane direction of the circuit board is present on a housing surface of the electronic device. A technique in which a coil is caused to function as antenna by receiving the component is described in Patent Document 1. More specifically, in Patent Document 1, an antenna structure obtained by winding a coil on a ferrite core to reduce an occupied area of a coil is described.

PRIOR-ART DOCUMENTS

Patent Document

PTL1: Japanese Patent Application Laid-Open No. 2008-35464

SUMMARY OF THE INVENTION

As described above, since a good conductor such as a circuit board that relatively easily conducts electricity is used in the electronic device such as a mobile phone, when an eddy current is generated on the circuit board that receives a magnetic field, magnetic fluxes are reflected. For example, on a housing surface of the mobile phone, a magnetic field radiated from a reader-writer tends to be strong at an outer peripheral part of the housing surface and to be weak near the center of the housing surface.

In an antenna using a normal loop coil, an opening of the loop coil is located at a central part of a mobile phone in which a magnetic field passing through the outer peripheral part of the housing surface can be rarely received. For this reason, in the antenna using the normal loop coil, efficiency of receiving a magnetic field is poor.

In the antenna structure described in Patent Document 1, since a sectional area of a ferrite core is in proportion to a magnetic flux density, the thickness of the ferrite core must be 1 mm or more, and a housing of a mobile phone has a relatively thick structure. For this reason, the antenna described in Patent Document 1 cannot be easily mounted in a thin mobile phone. Furthermore, when an antenna module is incorporated on a back side of a liquid crystal display mounted on a flip phone, the antenna module is required to be thin. For this reason, the antenna structure described in Patent Document 1 is difficult to be mounted on the flip phone.

An antenna module incorporated in a mobile phone or the like is desired to realize high communication characteristics by increasing the number of turns of an antenna coil while reducing a housing of an electronic device in size when the antenna module is incorporated in the electronic device.

The present invention has been proposed in consideration of the above circumstances, and has as its object to provide an antenna module that can realize high communication characteristics while reducing a housing of an electronic device when the antenna module is incorporated in the electronic device, a communication device and a method of manufacturing an antenna module.

In order to solve the above problem, according to the present invention, an antenna module that is incorporated in an electronic device and becomes communicable in response to a magnetic field transmitted from a transmitter includes: an antenna coil that is arranged on an outer peripheral part of a housing surface facing the transmitter of the electronic device and electromagnetically coupled to the transmitter; and a magnetic sheet that attracts a magnetic field transmitted from the transmitter to the antenna coil, wherein the antenna coil and the magnetic sheet are superimposed in a direction orthogonal to the housing surface such that the antenna coil is arranged to be closer to the transmitter than the magnetic sheet on an outer peripheral side of the housing surface and the magnetic sheet is arranged to be closer to the transmitter than the antenna coil on a center side of the housing surface, and the antenna coil is arranged such that at least a part of a conductive line is superimposed in the direction orthogonal to the housing surface.

A communication device according to the present invention that is incorporated in an electronic device and becomes communicable in response to a magnetic field transmitted from a transmitter including: an antenna coil that is arranged on an outer peripheral part of a housing surface facing the transmitter of the electronic device and electromagnetically coupled to the transmitter; a magnetic sheet that attracts a magnetic field transmitted from the transmitter to the antenna coil; and a communication processing unit that is driven by a current flowing in the antenna coil and communicates with the transmitter, wherein the antenna coil and the magnetic sheet are superimposed in a direction orthogonal to the housing surface such that the antenna coil is arranged to be closer to the transmitter than the magnetic sheet on an outer peripheral side of the housing surface and the magnetic sheet is arranged to be closer to the transmitter than the antenna coil on a center side of the housing surface, and the antenna coil is arranged such that at least a part of a conductive line is superimposed in the direction orthogonal to the housing surface.

A method of manufacturing an antenna module, in an antenna module that is incorporated in an electronic device and becomes communicable in response to a magnetic field transmitted from a transmitter includes: the step of preparing an antenna coil that is arranged on an outer peripheral part of a housing surface facing the transmitter of the electronic device and electromagnetically coupled to the transmitter; and the step of preparing a magnetic sheet that attracts a magnetic field transmitted from the transmitter to the antenna coil. The antenna coil and the magnetic sheet are superimposed in a direction orthogonal to the housing surface such that the antenna coil is arranged to be closer to the transmitter than the magnetic sheet on an outer peripheral side of the housing surface and the magnetic sheet is arranged to be closer to the transmitter than the antenna coil on a center side of the housing surface, and the antenna coil is arranged such that at least a part of a conductive line is superimposed in the direction orthogonal to the housing surface.

EFFECTS OF INVENTION

According to the present invention, since the antenna coil and the magnetic sheet are superimposed in a direction orthogonal to the housing surface such that the antenna coil is arranged to be closer to the transmitter than the magnetic sheet on an outer peripheral side of the housing surface and the magnetic sheet is arranged to be closer to the transmitter than the antenna coil on a center side of the housing surface, magnetic fluxes generated on the outer peripheral part of the housing surface of the electronic device facing the transmitter can be efficiently attracted to the antenna coil.

Furthermore, according to the present invention, since at least one part of the conductive line of the antenna coil is superimposed in the direction orthogonal to the housing surface, the number of turns of the antenna coil can be increased while suppressing a resistance from increasing depending on the line width of the conductive line and a coil area in the direction of the housing surface from increasing. For this reason, high communication characteristics can be realized.

Thus, the present invention can realize high communication characteristics while reducing the housing of the electronic device in size when the antenna coil is incorporated in the electronic device.

BRIEF DESCRIPTION OF DRAWINGS

FIG. 7A is an exploded perspective view of the communication device, and FIG. 7B is a perspective view of the communication device. FIG. 7C is a diagram typically showing a state in which the communication device is mounted on a circuit board in a mobile phone.

FIG. 8A shows a case in which the coil is connected in parallel, and FIG. 8B shows a case in which the coil is connected in series.

FIG. 12A is a plan view of the communication device, and FIG. 12B is a perspective view of the communication device.

FIG. 13A is a plan view of the communication device, and FIG. 13B is a perspective view of the communication device.

FIG. 14A is a plan view of the communication device, and FIG. 14B is a perspective view of the communication device.

FIG. 15A is a plan view of the communication device, and FIG. 15B is a perspective view of the communication device.

FIG. 19A is an exploded perspective view of the communication device, and FIG. 19B is a perspective view of the communication device.

FIG. 28A shows a case in which b=0 mm, FIG. 28B shows a case in which b=1 mm, FIG. 28C shows a case in which b=3 mm.

FIG. 31A is a perspective view showing a shape of a coil formed by a conductive line on a developed printed-circuit board. FIG. 31B is a perspective view showing a state in which a magnetic sheet is mounted on the coil. FIG. 31C is a perspective view showing a state in which both ends of the printed-circuit board are folded on the upper surface side of the magnetic sheet to form a communication device.

FIG. 35A is a perspective view showing a case in which a magnetic sheet having a thickness of about 1 mm, and FIG. 35B is a perspective view showing a case in which a magnetic sheet having a thickness of about 3 mm is used.

FIG. 36A is a perspective view showing a shape of a coil formed by a conductive line on a developed printed-circuit board. FIG. 36B is a perspective view showing a state in which a magnetic sheet is mounted on a coil. FIG. 36C is a perspective view showing a state in which both ends of the printed-circuit board are folded on an upper surface side and a lower surface side of a magnetic sheet to form a communication device.

FIG. 38A is an exploded perspective view of a communication device in which a shape of a coil formed by a conductive line on a first printed-circuit board, a magnetic sheet, and a shape of a coil formed by a conductive line on a second printed-circuit board are shown. FIG. 38B is a perspective view showing a state in which elements in FIG. 38A are laminated and a conductive line is electrically connected to form a communication device.

FIG. 42A is a perspective view showing three antenna circuit boards arranged on the outer peripheral parts on the outer peripheral side 130*a* side, the outer peripheral side 130*b* side, and the outer peripheral side 130*c* side. FIG. 42B is a perspective view showing two antenna circuit boards arranged on the outer peripheral parts on the outer peripheral side 130*a* side, the outer peripheral side 130*b* side, and the outer peripheral side 130*c* side.

FIG. 43 is a perspective view showing four antenna circuit boards arranged on the outer peripheral parts on the outer peripheral side 130*a* side, the outer peripheral side 130*b* side, the outer peripheral side 130*c* side, and the outer peripheral side 130*d* side.

DETAILED DESCRIPTION OF THE INVENTION

Embodiments of the present invention will be described below in detail with reference to the accompanying drawings. The present invention is not limited to only the following embodiments, and various changes can be effected without departing from the gist of the present invention.

<Entire Configuration>

Figure 1:
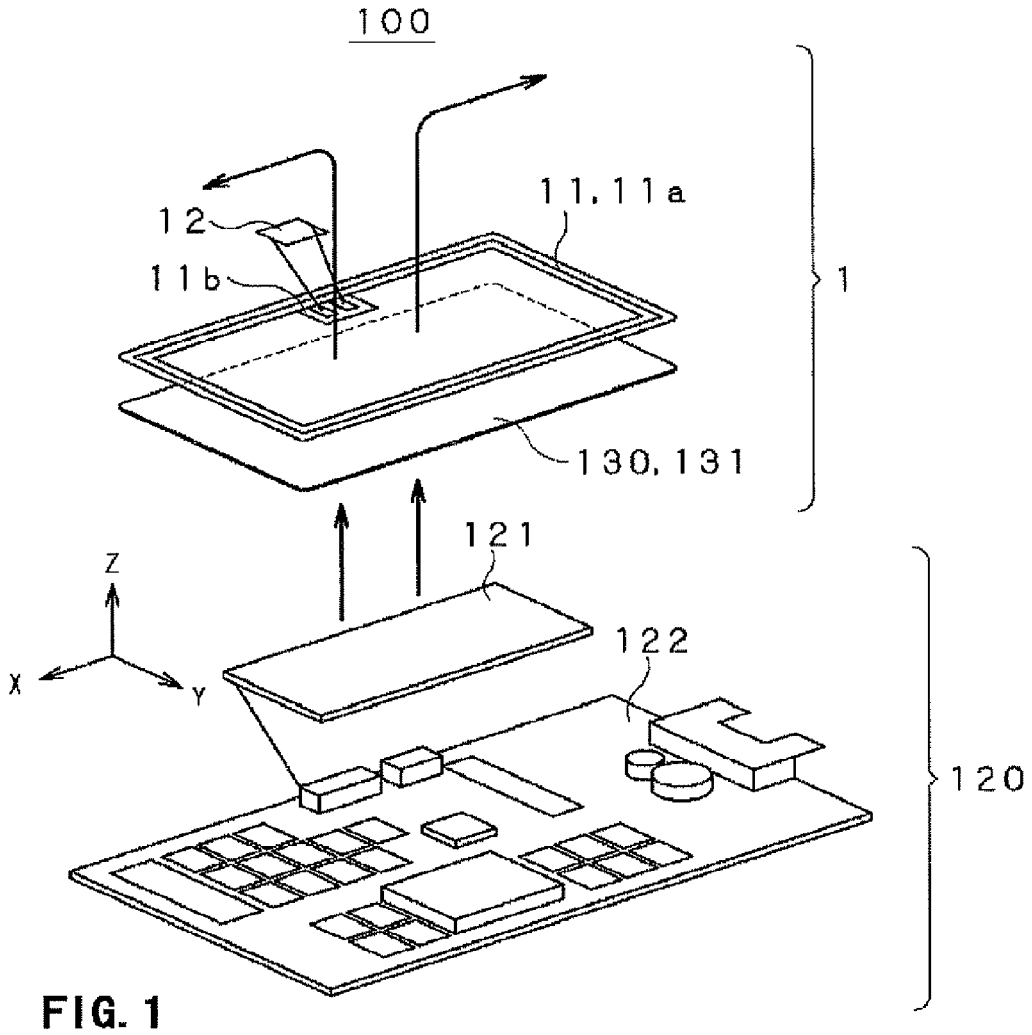
FIG. 1 is an exploded perspective view for explaining a configuration of a wireless communication system in which a communication device to which the present invention is applied is incorporated.

A communication device to which the present invention is applied is a device that is incorporated in an electronic device and becomes communicable in response to a magnetic field transmitted from a transmitter, and is used by being incorporated in a wireless communication system 100 for RFID (Radio Frequency Identification) as shown in, for example, FIG. 1.

The wireless communication system 100 includes a communication device 1 according to a first embodiment to which the present invention is applied, and a reader-writer 120 that accesses the communication device 1. The communication device 1 and the reader-writer 120 are arranged to face each other on an x-y plane of a three-dimensional orthogonal coordinate system xyz.

The reader-writer 120 functions a transmitter that transmits a magnetic field in a z-axis direction to the communication device 1 facing the reader-writer 120 on the x-y plane. More specifically, the reader-writer 120 includes an antenna 121 that transmits a magnetic field to the communication device 1 and a control circuit board 122 that communicates with the communication device 1 electromagnetically coupled to the control circuit board 122 through the antenna 121.

More specifically, in the reader-writer 120, the control circuit board 122 electrically connected to the antenna 121 is arranged. On the control circuit board 122, a control circuit including electronic parts such as one integrated circuit chip or a plurality of integrated circuit chips is mounted. The control circuit executes various processes on the basis of data received from the communication device 1. For example, when the control circuit transmits data to the communication device 1, the control circuit encodes data, modulates a carrier wave having a predetermined frequency (for example, 13.56 MHz) on the basis of the encoded data, amplifies the modulated modulation signal, and drives the antenna 121 by the amplified modulation signal. When the control circuit reads data from the communication device 1, the control circuit amplifies the modulation signal of the data received by the antenna 121, demodulates the amplified modulation signal of the data, and decodes the demodulated data. In the control circuit, an encoding scheme and a modulation scheme used in a general reader-writer are used. For example, Manchester encoding or ASK (Amplitude Shift Keying) modulation are used.

The communication device 1, for example, is incorporated in a housing 131 of a mobile phone 130 arranged to face the reader-writer 120 on an x-y plane. The communication device 1 includes an antenna circuit board 11 on which an antenna coil 11*a* that can communicate with the reader-writer 120 electromagnetically coupled to the antenna coil 11*a*, and a communication processing unit 12 that is driven by a current flowing in the antenna coil 11*a* and communicates with the reader-writer 120.

On the antenna circuit board 11, the antenna coil 11*a* formed by performing a patterning process or the like to a flexible conductive line such as a flexible flat cable and a terminal unit 11*b* that electrically connects the antenna coil 11*a* and the communication processing unit 12 to each other are mounted.

When the antenna coil 11*a* receives a magnetic field transmitted from the reader-writer 120, the antenna coil 11*a* is electromagnetically coupled to the reader-writer 120, and receives a modulated electromagnetic wave to supply a received signal to the communication processing unit 12 through the terminal unit 11*b*.

The communication processing unit 12 is driven by a current flowing in the antenna coil 11*a*, and communicates with the reader-writer 120. More specifically, the communication processing unit 12 demodulates the received modulation signal, decodes the demodulated data, and writes the decoded data in an internal memory held in the communication processing unit 12. The communication processing unit 12 reads data to be transmitted to the reader-writer 120 from the internal memory, encodes the read data, modulates a carrier wave on the basis of the encoded data, and transmits a radio wave modulated through the antenna coil 11*a* coupled by electromagnetic induction to the reader-writer 120.

In the wireless communication system 100 having the above configuration, configurations of the communication device 1 according to the embodiment and a communication device 201 according to a comparative example will be described below.

Figure 2:
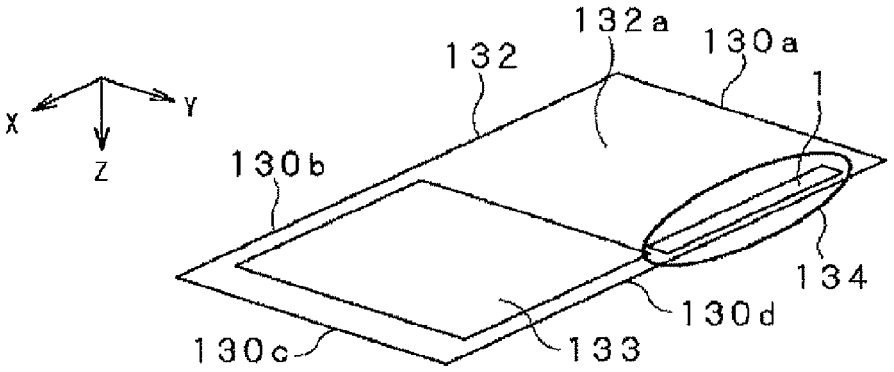
FIG. 2 is a perspective view for explaining a configuration of a communication device arranged in a housing of a mobile phone.

The communication device 1 according to the embodiment and the communication device 201 according to the comparative example must maintain communication characteristics with the reader-writer 120. Furthermore, when the communication device 1 or 201 is incorporated in an electronic device such as the mobile phone 130, in terms of realization of a reduction in size and thickness of the electronic device, for example, on the x-y plane as shown in FIG. 2, the communication device 1 or the communication device 201 is arranged on a circuit board 132 in the housing 131 of the mobile phone 130. In FIG. 2, in a region of a part of the circuit board 132, a magnetic sheet 133 is arranged to cover a battery pack to drive the mobile phone 130.

An antenna coil 211*a* of the communication device 201 (will be described later) is preferably arranged at a position where the intensity of a magnetic field from the reader-writer 120 is high to maintain communication characteristics between the antenna coil 211*a* and the reader-writer 120. In this case, since the circuit board 132 of the mobile phone 130 relatively easily conducts electricity, when an external AC magnetic field is applied to the circuit board 132 to generate an eddy current, thereby reflecting a magnetic field. When a magnetic field distribution obtained when the external AC magnetic field is applied is examined, the magnetic fields of the four outer peripheral sides 130*a*, 130*b*, 103*c*, and 130*d* on the surface of the housing 131 of the mobile phone 130 arranged to face the reader-writer 120 tend to be strong.

By using the tendency of a magnetic field intensity in the housing 131 of the mobile phone 130, the communication device 1 according to the embodiment and the communication device 201 according to the comparative example, as shown in FIG. 2, are arranged on an outer peripheral part 134 on the outer peripheral side 130*d* side of the outer peripheral sides 130*a*, 130*b*, 130*c*, and 130*d* having the strong magnetic fields. In this manner, the communication device 1 or 201 can be arranged at a portion having a relatively high magnetic field intensity on the circuit board 132 of the mobile phone 130.

Comparative Example

Prior to the explanation of the communication device 1 according to the embodiment, a concrete configuration of the communication device 201 according to the comparative example will be described below.

A magnetic field of the outer peripheral part 134 on which the communication device 201 according to the comparative example is arranged has a large magnetic field component in the planar direction of the circuit board 132, more specifically, a large magnetic field component in a y-axis direction from a central part 132*a* of the circuit board 132 to the outer peripheral side 130*d*. In order to efficiently attract a component of a magnetic field extending from the central part 132*a* of the circuit board 132 to the outer peripheral side 130*d* to the antenna coil 211*a*, the communication device 201 include a magnetic sheet 213 arranged as shown in FIG. 3 and superimposed on the antenna coil 211*a*.

Figure 3A:
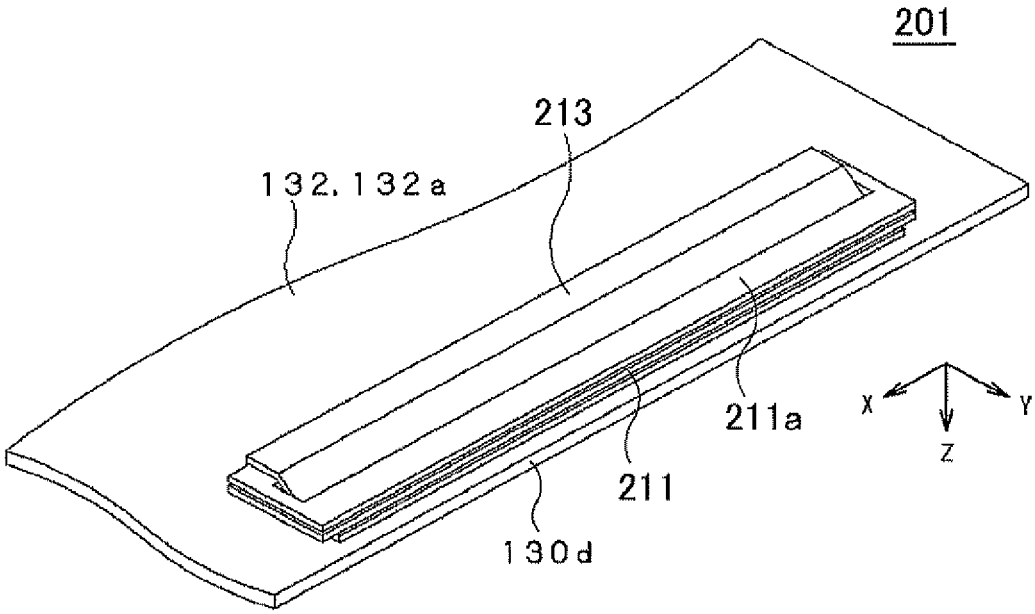
FIG. 3A is a perspective view of an antenna circuit board according to a comparative example.
Figure 3B:
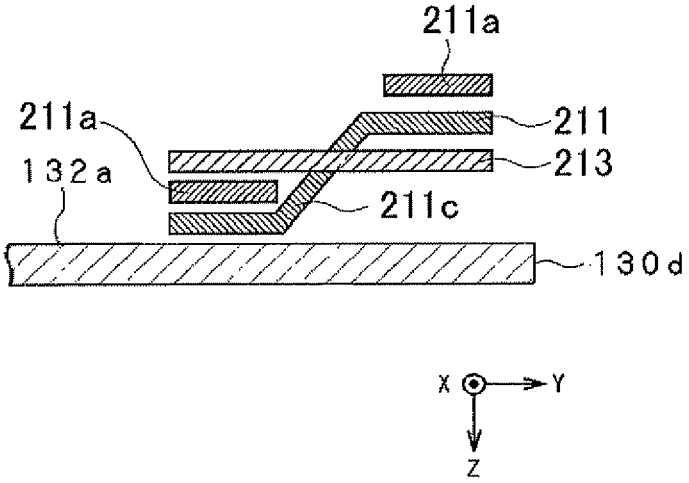
FIG. 3B is a sectional view of the antenna circuit board according to the comparative example.

In this case, FIG. 3A is a perspective view of an antenna circuit board 211 into which the magnetic sheet 213 is inserted on the x-y plane, and FIG. 3B is a sectional view of the antenna circuit board 211 into which the magnetic sheet 213 is inserted in an insertion direction parallel to the y axis on the x-y plane. In the communication device 201 shown in FIG. 3, the number of turns of the antenna coil 211*a* is set to 1.

As shown in FIG. 3B, in the communication device 201 according to the comparative example, the magnetic sheet 213 is inserted into a central part 211*c* of the antenna coil 211*a* formed on the antenna circuit board 211. On the central part 132*a* side of the circuit board 132, the magnetic sheet 213 is arranged to be closer to the reader-writer 120 than the antenna coil 211*a*. On the outer peripheral side 130*d* side of the circuit board 132, the antenna coil 211*a* is arranged to be closer to the reader-writer 120 than the magnetic sheet 213.

In this case, as the antenna circuit board 211, as described above, the flexible printed-circuit board, a rigid printed-circuit board, or the like is used. In particular, by using the flexible printed-circuit board, the central part of the antenna coil 211*a* is notched, an opening can be easily formed, and the magnetic sheet 213 can be easily inserted into the opening. In the communication device 201, in terms of that the magnetic sheet 213 is easily inserted into the antenna circuit board 211, the antenna circuit board 211 is formed by using the flexible printed-circuit board. Similarly, communication devices 1 and 2 according to the embodiment (will be described later), in terms of that the magnetic sheet is easily inserted into the antenna circuit board, the antenna circuit board is preferably formed by using the flexible printed-circuit board. More specifically, by using the flexible printed-circuit board, the communication device 201 and communication devices 1, 2, and 3 according to the embodiments (will be described later can be easily manufactured.

In the communication device 201, on the central part 132*a* side of the circuit board 132, the magnetic sheet 213 is arranged to be closer to the reader-writer 120 than the antenna coil 211*a*. On the outer peripheral side 130*d* side of the circuit board 132, the antenna coil 211*a* is arranged to be located on the reader-writer 120 side. In this manner, a magnetic field generated on the outer peripheral part 134 can be efficiently attracted to the antenna coil 211*a*.

The magnetic field generated on the outer peripheral part 134 can be efficiently attracted to the antenna coil 211*a* because the magnetic sheet 213 is arranged such that a magnetic field component from the central part 132*a* of the circuit board 132 to the outer peripheral side 130*d* efficiently pass through the opening of the antenna coil 211*a*.

In this case, in order to improve communication characteristics of the antenna coil, in general, the number of turns of the coil (to be simply referred to as "the number of turns" hereinafter) may be increased. In the antenna coil 211*a* of the communication device 201 according to the comparative example, as described above, in consideration of arranged on the outer peripheral part 134 on the outer peripheral side 130*d* side, outside dimensions of the antenna coil are difficult to be increased. For this reason, the number of turns must be increased under the condition in which the outside dimensions are constant.

In a case in which the number of turns is changed under the above condition, a resistance of the antenna coil 211*a*, a self-inductance (to be simply referred to as an "inductance" hereinafter) value, and a Q value will be described with reference to FIGS. 4 to 5. The Q value is one of evaluation indexes of an antenna coil, and is expressed by $Q=\omega L/R$ when reference symbol w denotes an angular frequency corresponding to a communication frequency; L denotes an inductance; and R denotes a resistance.

Figure 4A:
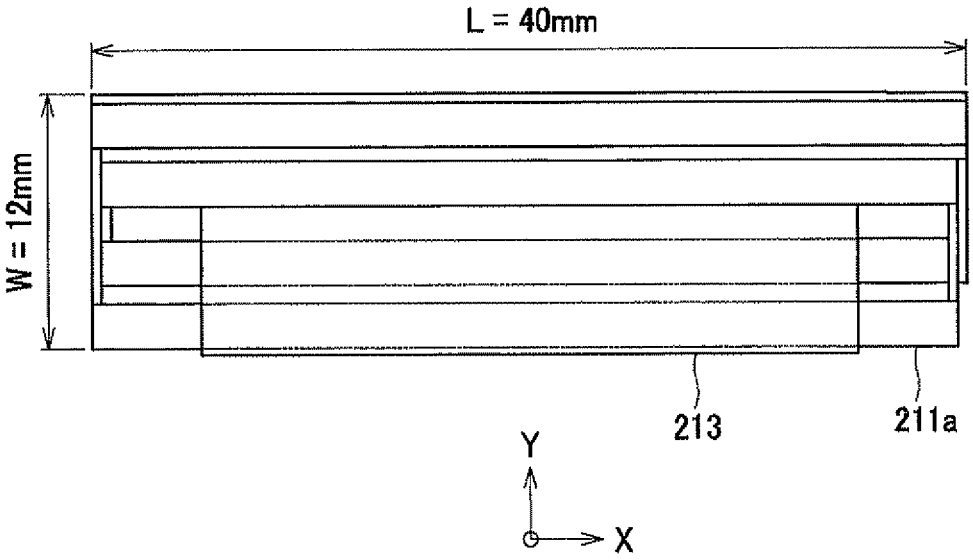
FIG. 4A is a plan view showing an outer shape of an antenna coil according to a comparative example in which the number of turns is 3.
Figure 4B:
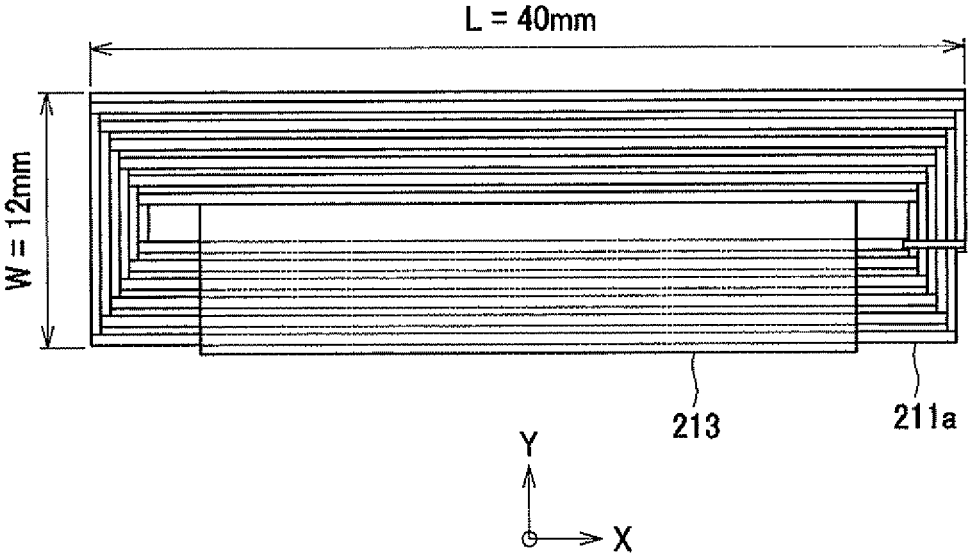
FIG. 4B is a plan view showing an outer shape of an antenna coil according to a comparative example in which the number of turns is 6.

FIG. 4A is a diagram showing an outer shape of the antenna coil 211*a* having the number of turns that is 2, and FIG. 4B is a diagram showing an outer shape of the antenna coil 211*a* having the number of turns that is 6. It is assumed that, the outer shape of the antenna coil 211*a* shown in FIGS. 4A and 4B is defined such that a width W regulated in a y-axis direction is 12 mm and a length L regulated in an x-axis direction is 40 mm. When the number of turns is increased under the condition in which the outside dimensions are set to be constant, the line width of a conductive line becomes narrow. As is apparent from a result shown in FIG. 5, a resistance becomes high.

Figure 5A:
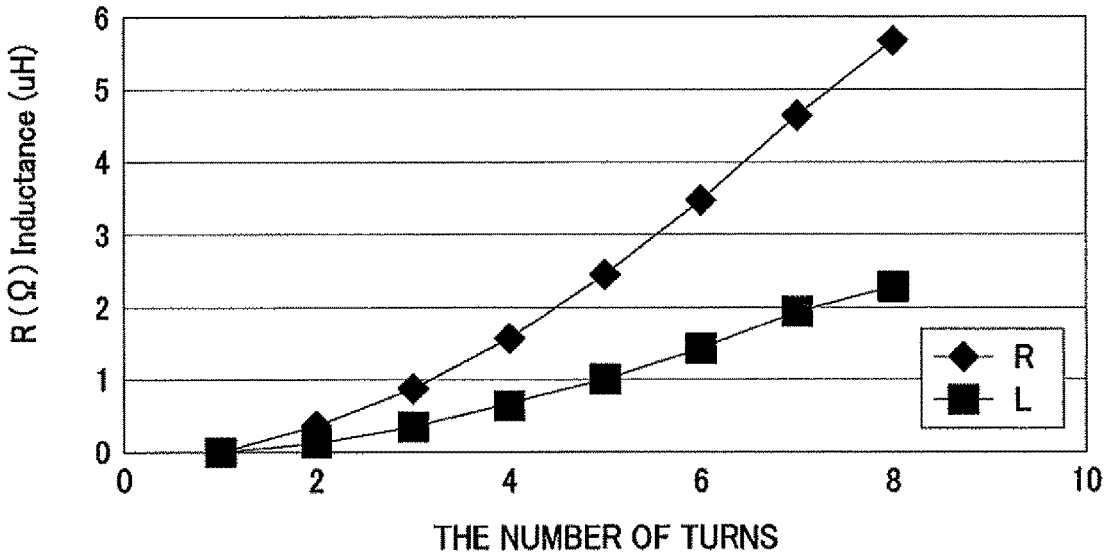
FIG. 5A is a graph showing a change in resistance of the antenna coil and a change in inductance when the number of turns is changed under the condition in which outside dimensions are constant in the comparative example.
Figure 5B:
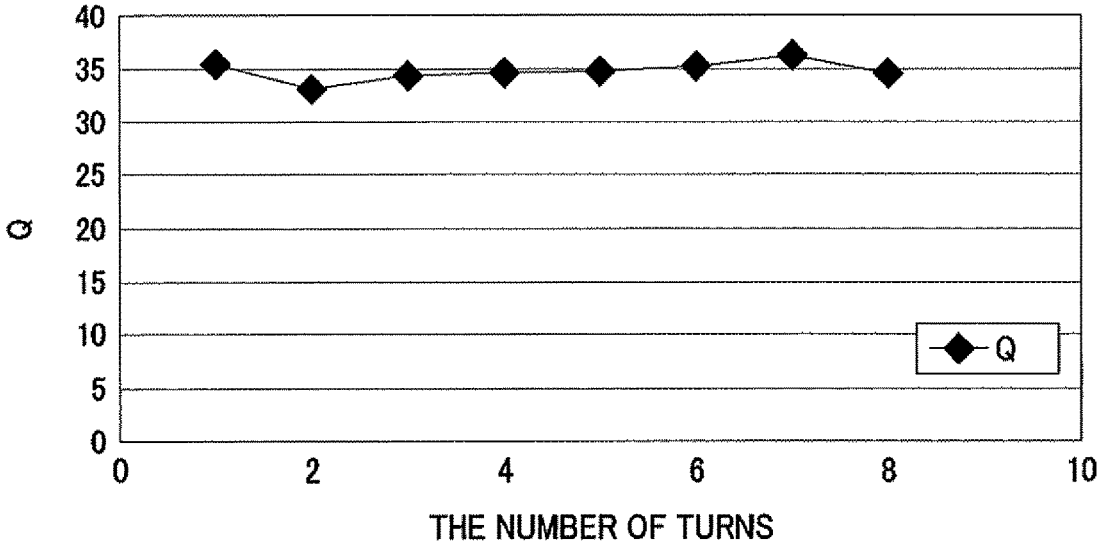
FIG. 5B is a graph showing a change in Q value when the number of turns is changed under the condition in which outside dimensions are constant in the comparative example.

FIG. 5A is a graph showing a change of a resistance R of the antenna coil 211*a* and a change of an inductance L when the number of turns is changed under the condition in which the outside dimensions are constant. FIG. 5B is a graph showing a change in Q value of the communication device 201 when the number of turns of the antenna coil 211*a* is changed under the condition in which the outside dimensions are constant.

As is apparent from FIG. 5, under the condition in which the outside dimensions of the antenna coil 211*a* are constant, when the number of turns is increased, the inductance L increases. However, since the resistance R also increases, the Q value does not become high.

Figure 6:
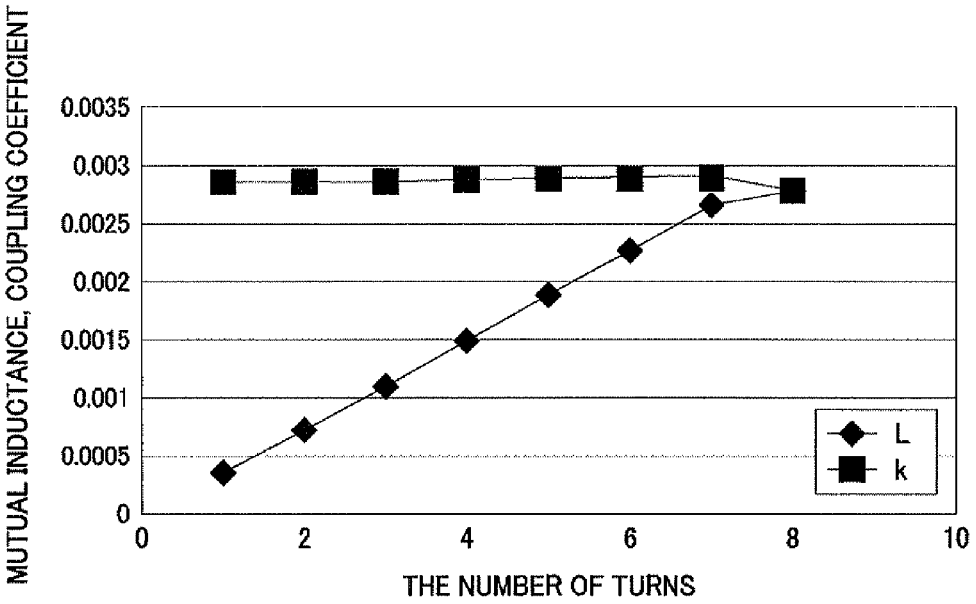
FIG. 6 is a graph showing a mutual inductance and a coupling coefficient between a reader-writer and an antenna when the number of turns is changed under the condition in which outside dimensions are constant of the antenna coil are constant in the comparative example.

Furthermore, FIG. 6 shows changes in mutual inductance and coupling coefficient between the communication device 201 and the antenna 121 of the reader-writer 120 when the number of turns is changed under the condition in which the outside dimensions of the antenna coil 211*a* are constant. As is apparent from FIG. 6, the inductance L increases when the number of turns increases, and a coupling coefficient k does not change even though the number of turns increases.

In this manner, under the condition in which the outside dimensions of the antenna coil 211*a* are constant, communication characteristics are difficult to be improved even though the number of turns is increased, and the communication characteristics are difficult to be improved by reducing the outer shape of the antenna coil in size.

First Embodiment

With respect to the communication device 201 according to the comparative example, as the first embodiment, in the communication device 1, communication characteristics are improved by increasing the number of turns without narrowing the line width of a conductive line of an antenna coil. For this reason, as shown in FIG. 7, an antenna coil 11*a* includes two antenna coils 11*a*1 and 11*a*2. It is assumed that each of the coils 11*a*1 and 11*a*2 has the same shape and the number of turn that is 2.

Figure 7A:
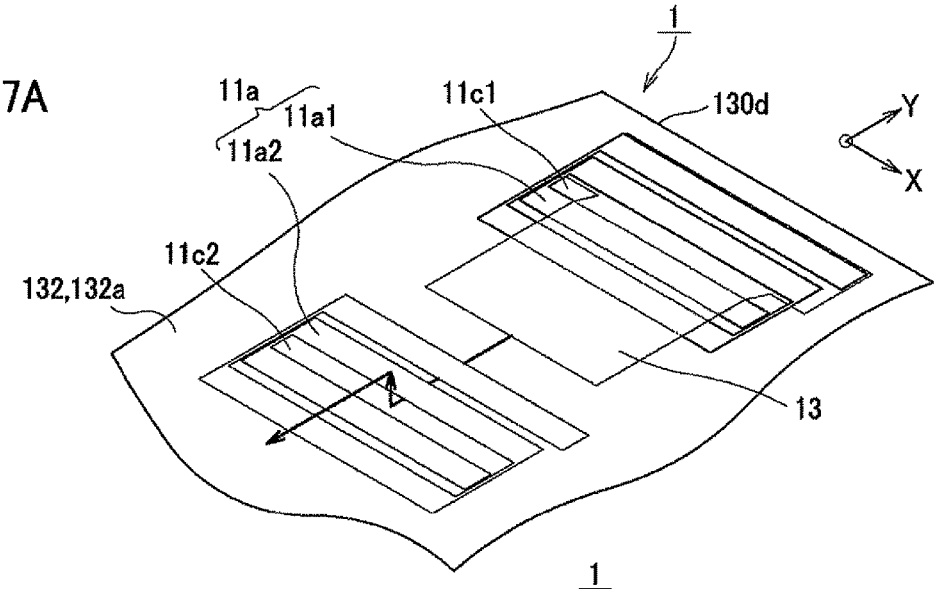
FIGS. 7A to 7C are diagrams for explaining a configuration of a communication device according to a first embodiment.

In the communication device 1, first, as shown in FIG. 7A, a magnetic sheet 13 is inserted into an opening 11*c*1 of the coil 11*a*1. On the central part 132*a* side of the circuit board 132, the magnetic sheet 13 is arranged to be closer to the reader-writer 120 than the coil 11*a*1. On the outer peripheral side 130*d* side of the circuit board 132, the coil 11*a*1 is arranged to be closer to the reader-writer 120 than the magnetic sheet 13. In the communication device 1, as shown in FIG. 7A, the magnetic sheet 13 into which the coil 11*a*1 is inserted is inserted into an opening 11*c*2 of the coil 11*a*2. On the central part 132*a* side of the circuit board 132, the magnetic sheet 13 is arranged to be closer to the reader-writer 120 than the coil 11*a*2. On the outer peripheral side 130*d* side of the circuit board 132, the coil 11*a*2 is arranged to be closer to the reader-writer 120 than the magnetic sheet 13. In this case, it is assumed that the coils 11*a*1 and 11*a*2, as shown in the sectional view in FIG. 7C, in a shape regulated in a planar direction of the circuit board 132, are inserted into the magnetic sheet 13 such that half regions of the coils 11*a*1 and 11*a*2 are superimposed on each other.

Figure 8A:
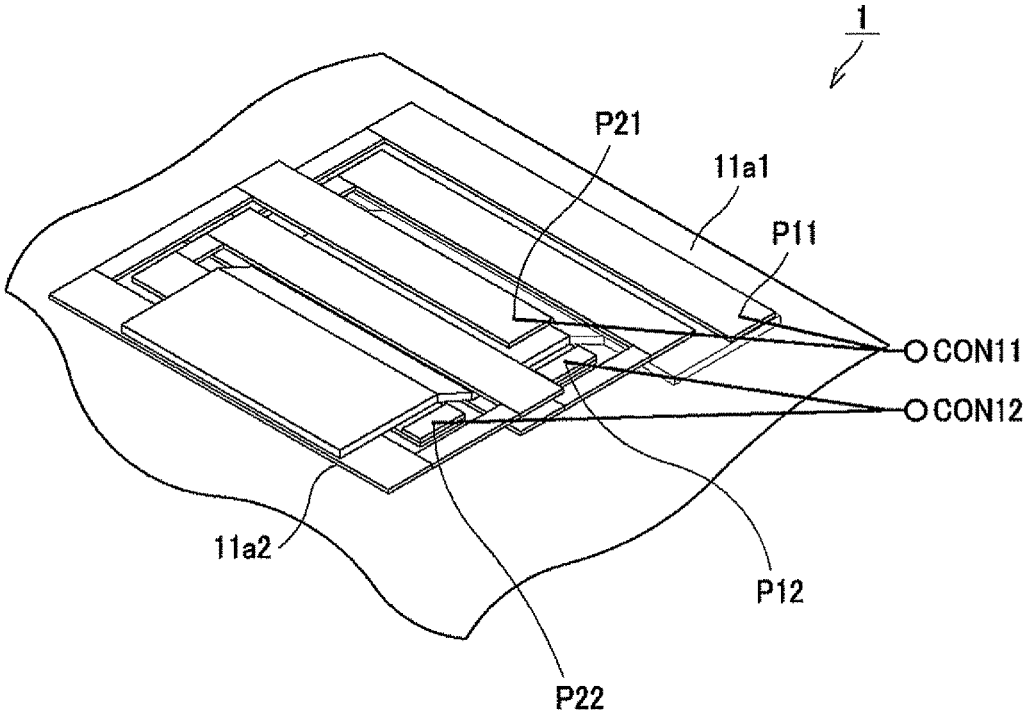
FIGS. 8A and 8B are perspective views for explaining a terminal structure of a terminal unit of the antenna coil in the first embodiment.
Figure 8B:
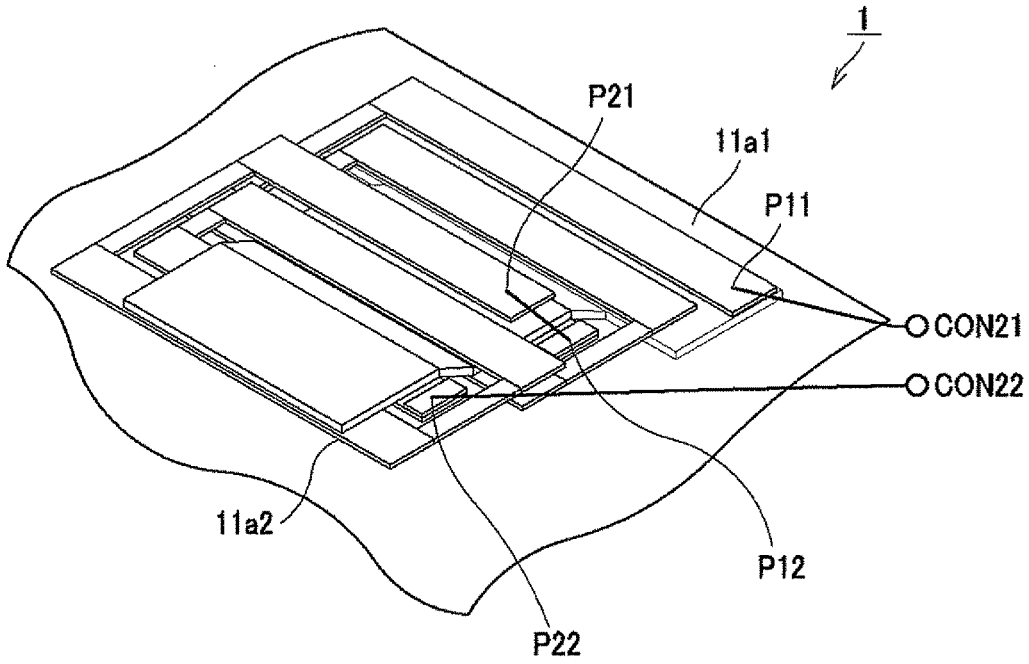

In the communication device 1, the coils 11*a*1 and 11*a*2 are connected in series with or in parallel to each other to function as one antenna coil 11*a*. However, as a terminal unit 11*b* connected to a communication processing unit 12, a terminal structure as described below may be employed. More specifically, the terminal unit 11*b*, as shown in FIG. 8A, has an input/output terminal structure configured by terminals CON11 and CON12 that connect the coils 11*a*1 and 11*a*2 in parallel to each other. Furthermore, as shown in FIG. 8B, the terminal unit 11*b* has an input/output terminal structure configured by the terminals CON11 and CON12 that connect the coils 11*a*1 and 11*a*2 in series with each other.

In this case, when terminals P11 and P12 are defined as end portions of the conductive line of the coil 11*a*1, respectively, and when terminals P21 and P22 are defined as end portions of the conductive line of the coil 11*a*2, a series connection and a parallel connection will be performed as described below. More specifically, in the parallel connection, the coils 11*a*1 and 11*a*2, as shown in FIG. 8A, the terminal P11 and the terminal P21 are connected to the terminal CON11, and the terminals P12 and P22 are connected to the terminal CON12. In the series connection, the coils 11*a*1 and 11*a*2, as shown in FIG. 8B, the terminal P11 is connected to the terminal CON21, the terminal P12 is connected to the terminal P21, and the terminal P22 is connected to the terminal CON22.

In the communication device 1, as the terminal structure of the terminal unit 11*b*, a 4-terminal structure including the terminals P11, P12, P21, and P22 is employed to electrically connect the coils 11*a*1 and 11*a*2 to each other. Furthermore, as a connection state, any one of the series connection and the parallel connection is selected and can be performed to make it possible to select an inductance of the antenna coil 11*a* in two steps depending on signal amplifying characteristics or the like of the communication processing unit 12 connected to the antenna coil 11*a*.

Figure 7B:
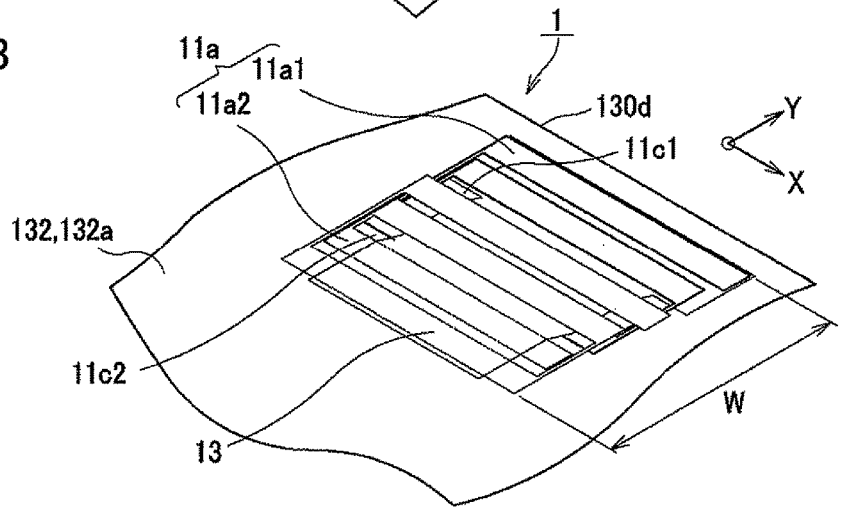
Figure 7C:
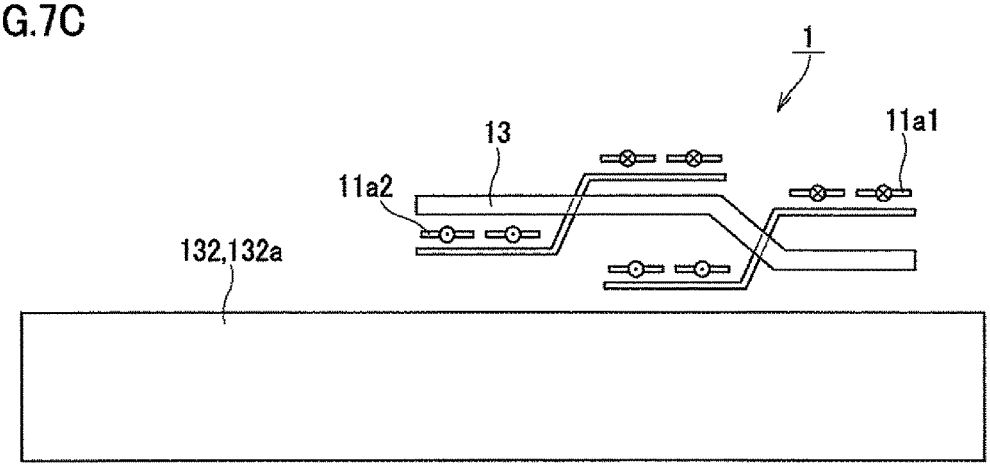

As described above, the communication device 1, as shown in FIGS. 7B and 7C, the coil 11*a*2 has the antenna coil 11*a* having a structure arranged to be closer to the central part 132*a* of the circuit board 132 than the coil 11*a*1.

In this case, under the condition in which the outer shape and the number of turns of the antenna coil 11*a* regulated on an x-y plane of the circuit board 132 are constant, the performances of the antenna coil 11*a* of the communication device 1 and the antenna coil 211*a* of the communication device 201 according to the comparative example are evaluated.

Figure 9:
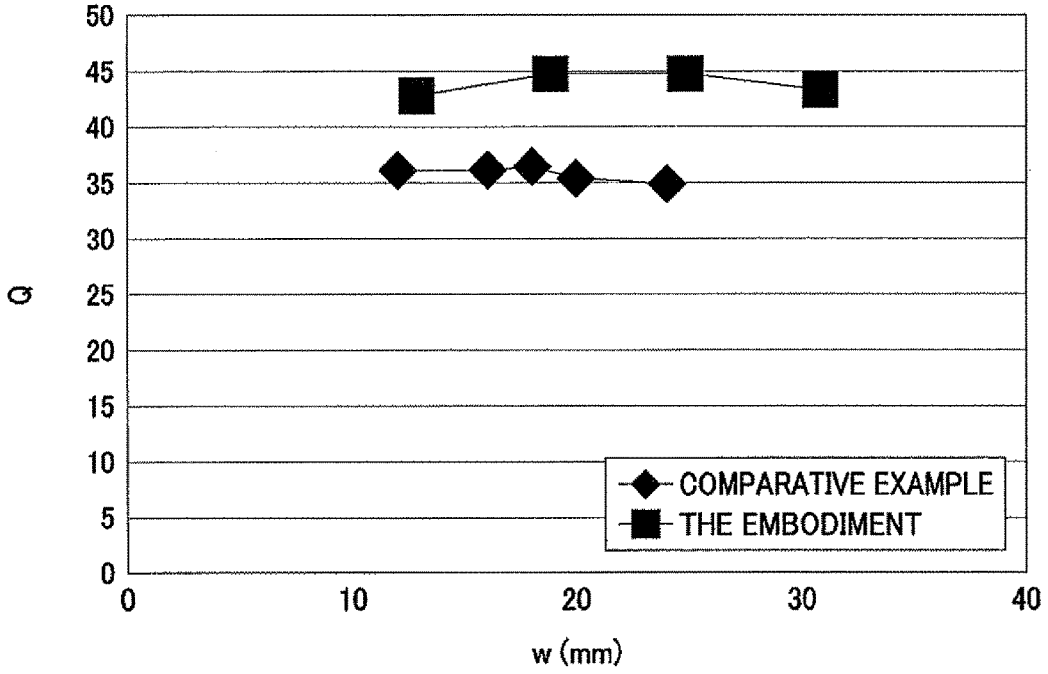
FIG. 9 is a graph showing a change in Q value of the antenna coil when a width W of the antenna coil regulated in a y-axis direction in the first embodiment.
Figure 10:
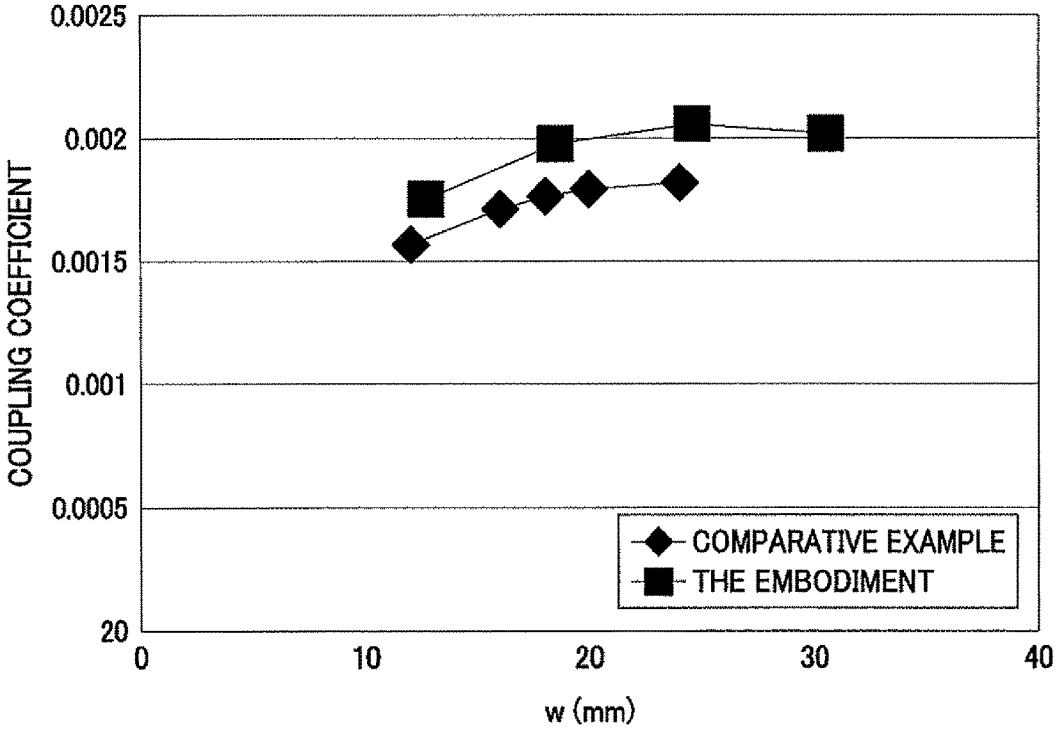
FIG. 10 is a graph showing a change in coupling coefficient between a reader-writer and the antenna when the width w of the antenna coil regulated in the y-axis direction in the first embodiment.

FIG. 9 is a graph showing a change in Q value of the antenna coil when a width W of the antenna coil 11*a*. FIG. 10 is a graph showing a change in coupling coefficient between the antenna coil 11*a* and the antenna 121 of the reader-writer 120 when the width W of the antenna coil.

As is apparent from the results in FIGS. 9 and 10, in comparison with the communication device 201 according to the comparative example, in the communication device 1, the line width of the coil can be averagely widened, and a resistance can be reduced. For this reason, the Q value can be made high, and the coupling coefficient can be made high. As a result, the communication characteristics can be improved.

In the communication device 1 having the above configuration, the magnetic sheet 13 is arranged such that a part of the conductive line of the coil 11*a*2 in which the magnetic sheet 13 is arranged on the circuit board 132 side and a part of the conductive line of the coil 11*a*1 arranged to be closer to the circuit board 132 side than the magnetic sheet 13 are superimposed in a direction orthogonal to the circuit board 132. In this manner, the number of turns can be increased without narrowing the line width of the conductive line. Thus, in the communication device 1, since the number of turns of the antenna coil 11*a* can be increased while suppressing an increase in resistance depending on the line width of the conductive line and an increase in coil area in the planar direction of the circuit board 132, improved communication characteristics can be realized.

In the communication device 1, at least, a part of the conductive line of the coil 11*a*2 and a part of the conductive line of the coil 11*a*1 need only be arranged to be superimposed in the direction orthogonal to the circuit board 132. For example, as shown in FIG. 7C, the coils 11*a*1 and 11*a*2 are very preferably inserted into the magnetic sheet 13 such that half regions of the outer shapes regulated in the planar direction of the circuit board 132 are superimposed on each other. More specifically, in the communication device 1, a part of the conductive line of the coil 11*a*2 in which the magnetic sheet 13 is arranged on the circuit board 132 side and a part of the conductive line of the coil 11*a*1 arranged to be closer to the circuit board 132 side than the magnetic sheet 13 are preferably superimposed on each other through the magnetic sheet 13 in terms of communication characteristics.

Figure 11:
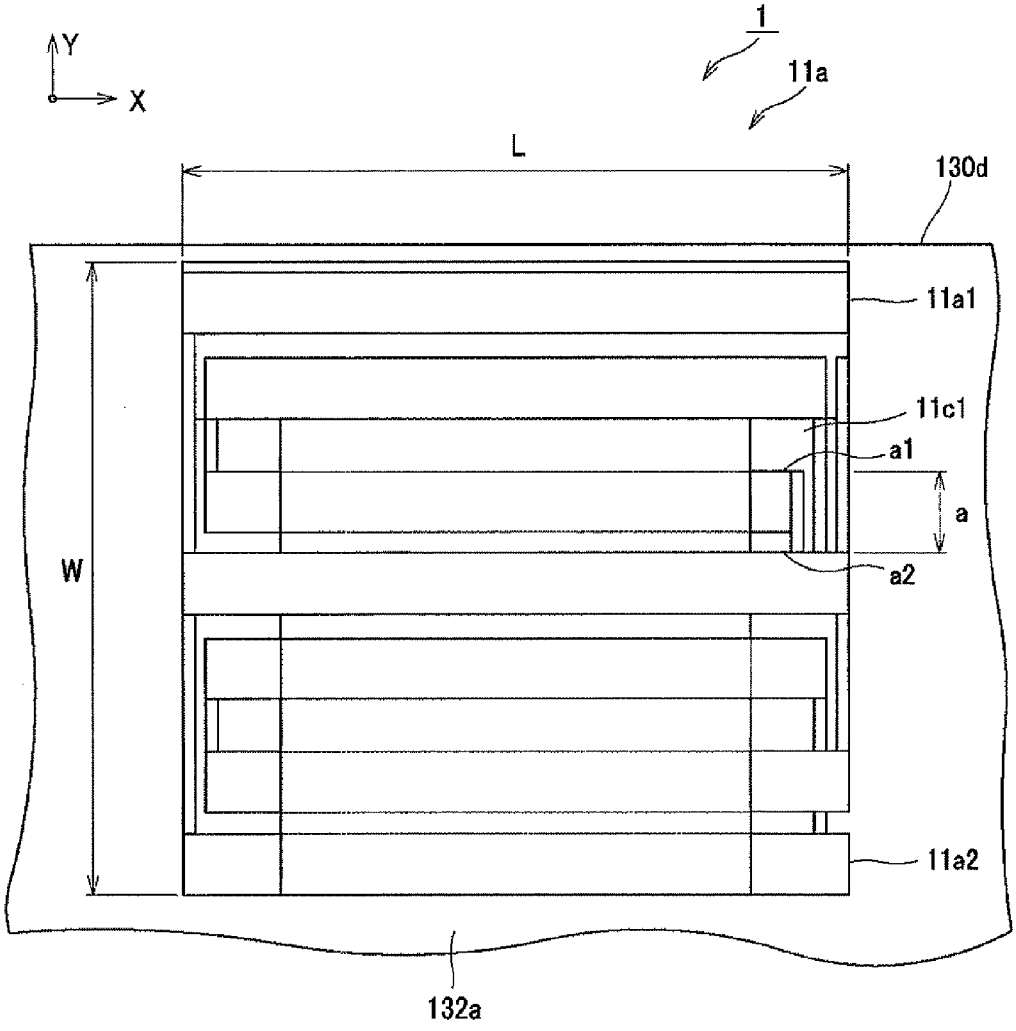
FIG. 11 is a plan view of a communication device for explaining a value that regulates a superimposing state of two coils configuring the antenna coil under the conditions in which outside dimensions of the antenna coil regulated as a width W and a length L are set to be constant, i.e., 20 mm and 20 mm, respectively.

In this case, as shown in FIG. 11, the outer shape of the antenna coil 11*a* regulated by the width W and the length L are set to be constant, i.e., 20 mm and 20 mm, respectively. As will be described below, a superimposing position between the coils 11*a*1 and 11*a*2 is expressed with a value a [mm] regulated in a direction of the width W. More specifically, when an end side a1 on the central part 132*a* side of the opening 11*c*1 of the coil 11*a*1 is used as an origin in a y-axis direction, a position of an end side a2 on the outer peripheral side 130*d* side of the coil 11*a*2 is defined as a [mm].

Figure 12A:
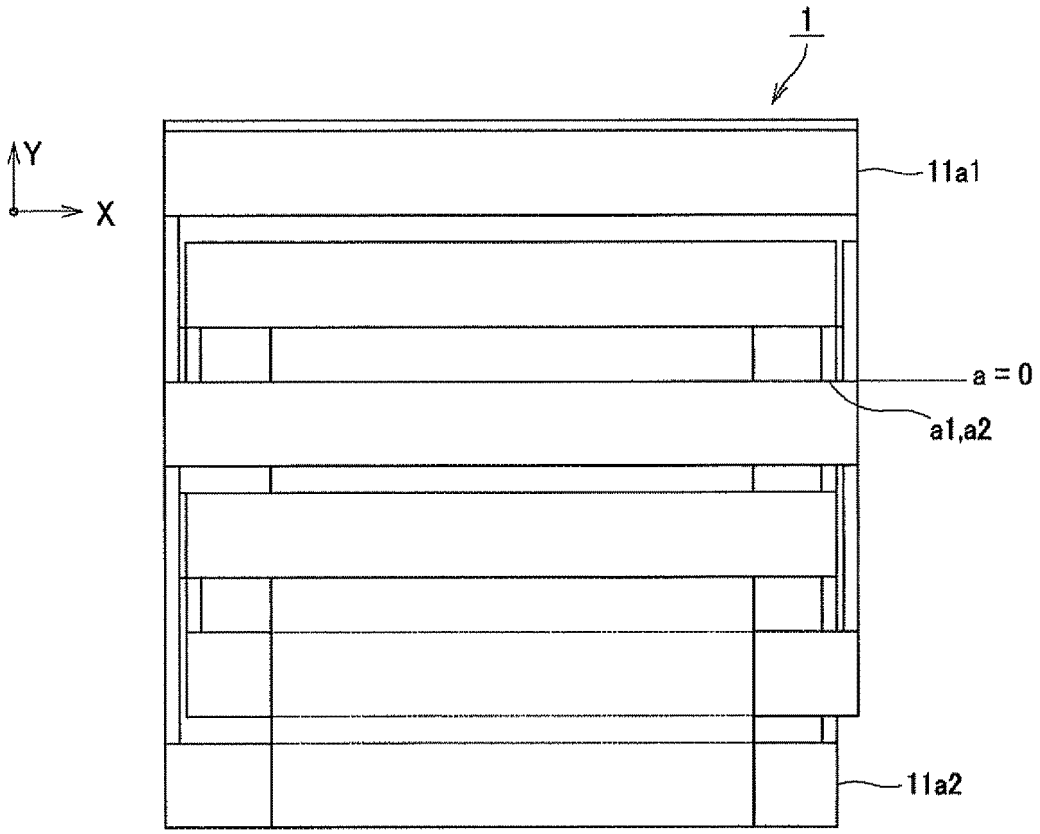
FIGS. 12A and 12B are diagrams for explaining a superimposing state in which the two coils are inserted into a magnetic sheet 13 such that almost—½ regions of the coils are superimposed on each other when a=0 [mm].
Figure 12B:
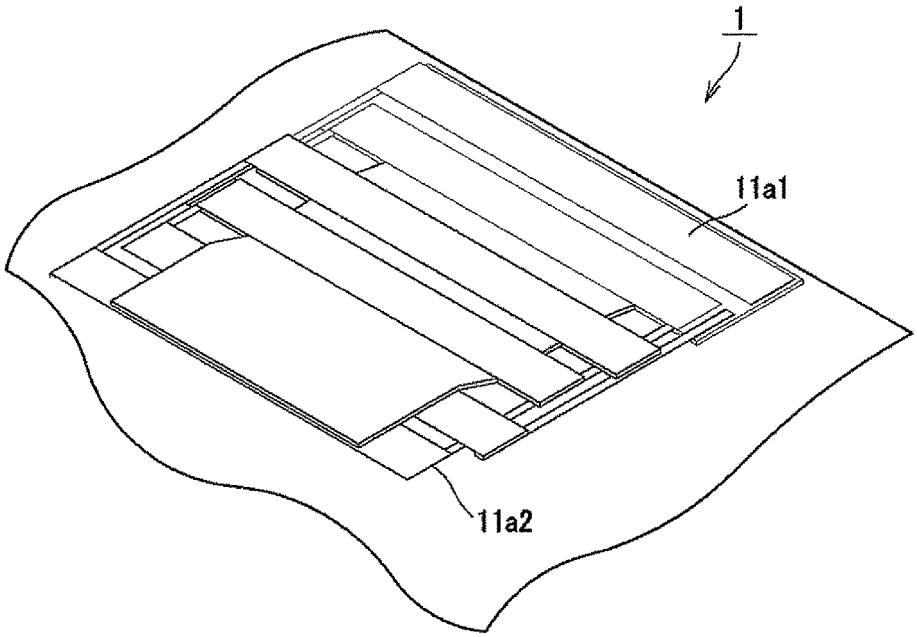

In this case, FIGS. 12A and 12B are a plan view and a perspective view showing the coils 11*a*1 and 11*a*2 that are inserted into the magnetic sheet 13 such that, when a=0 [mm], almost ½ regions of the coils 11*a*1 and 11*a*2 are superimposed on each other.

Figure 13A:
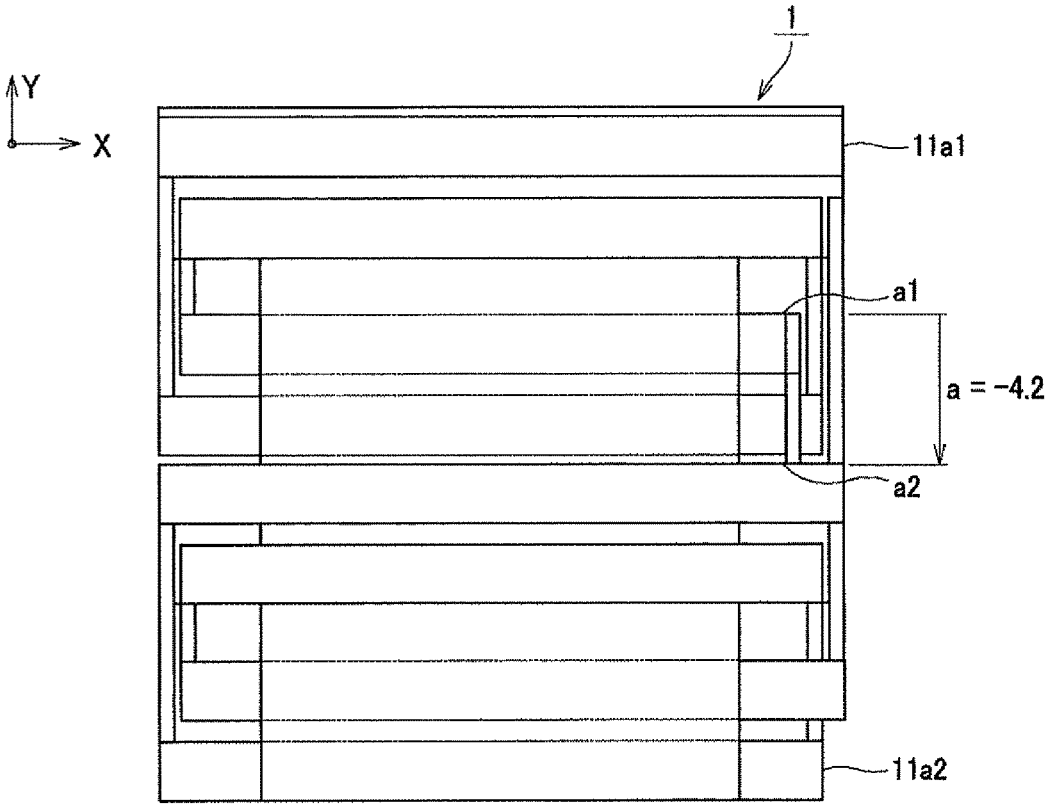
FIGS. 13A and 13B are diagrams for explaining a superimposing state in which the two coils are inserted into the magnetic sheet 13 such that almost—¼ regions of the coils are superimposed on each other when a=−4.2 [mm].
Figure 13B:
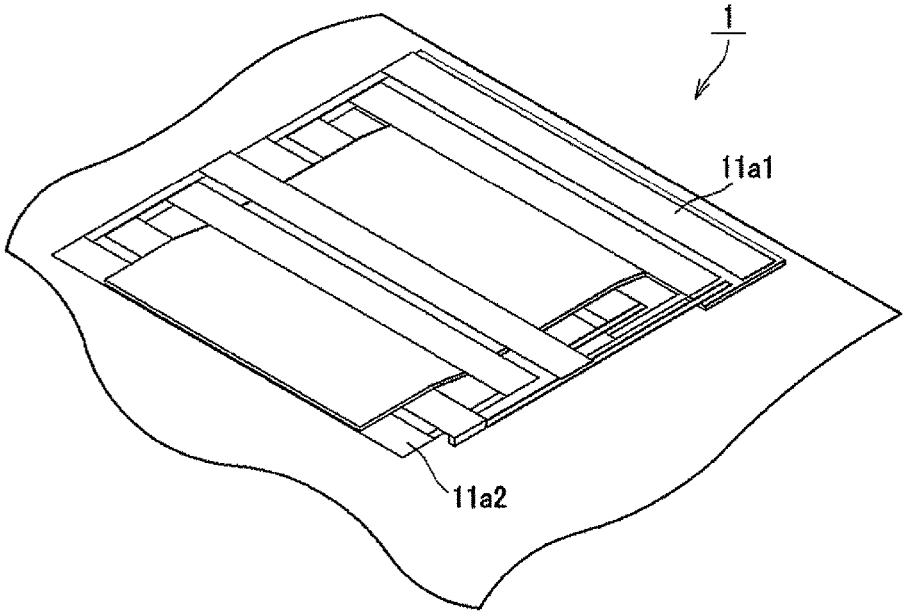

FIGS. 13A and 13B are a plan view and a perspective view showing the coils 11*a*1 and 11*a*2 that are inserted into the magnetic sheet 13 such that, when a=−4.2 [mm], almost ¼ regions of the coils 11*a*1 and 11*a*2 are superimposed on each other.

Figure 14A:
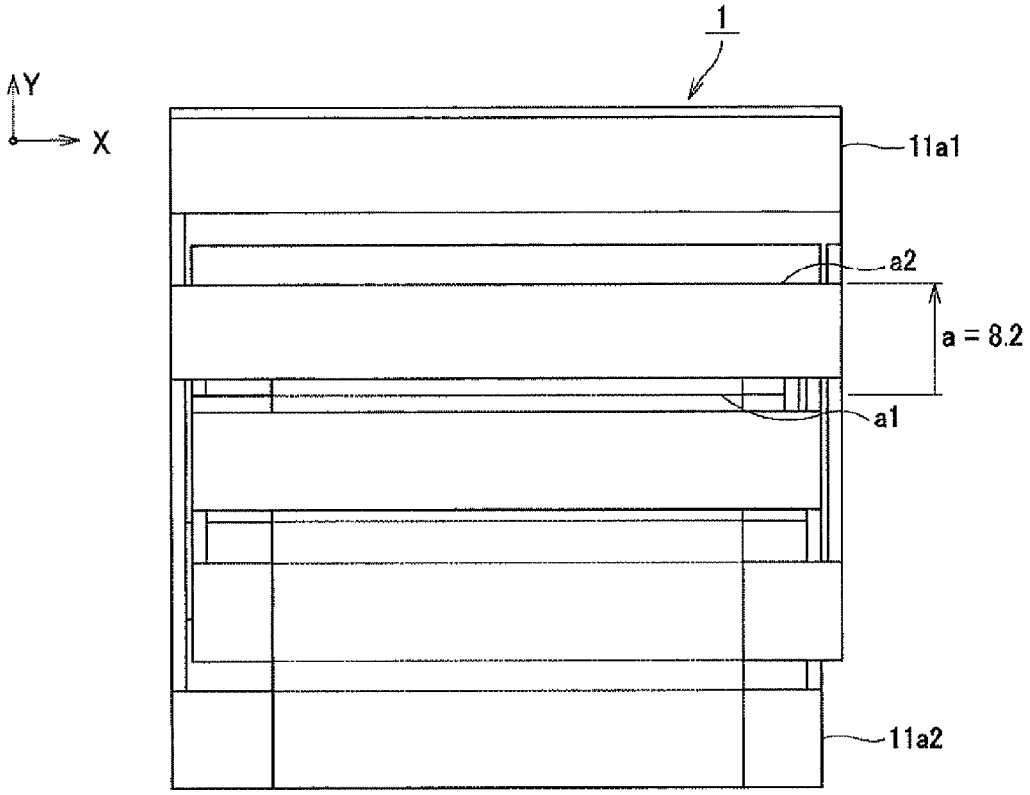
FIGS. 14A and 14B are diagrams for explaining a superimposing state in which the two coils are inserted into the magnetic coil sheet 13 such that almost—¾ regions of the coils are superimposed on each other when a=8.2 [mm].
Figure 14B:
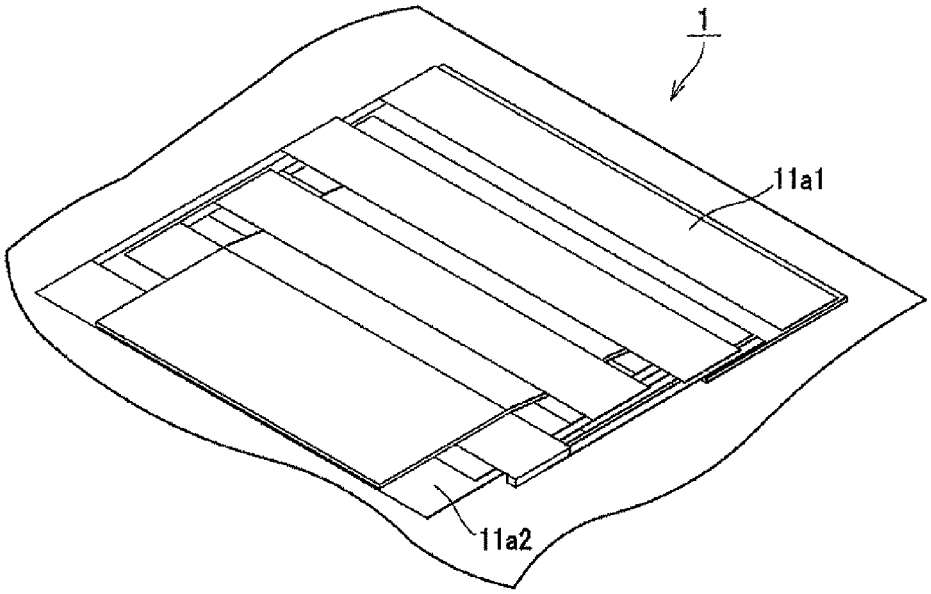

FIGS. 14A and 14B are a plan view and a perspective view showing the coils 11*a*1 and 11*a*2 that are inserted into the magnetic sheet 13 such that, when a=8.2 [mm], almost ¾ regions of the coils 11*a*1 and 11*a*2 are superimposed on each other.

Figure 15A:
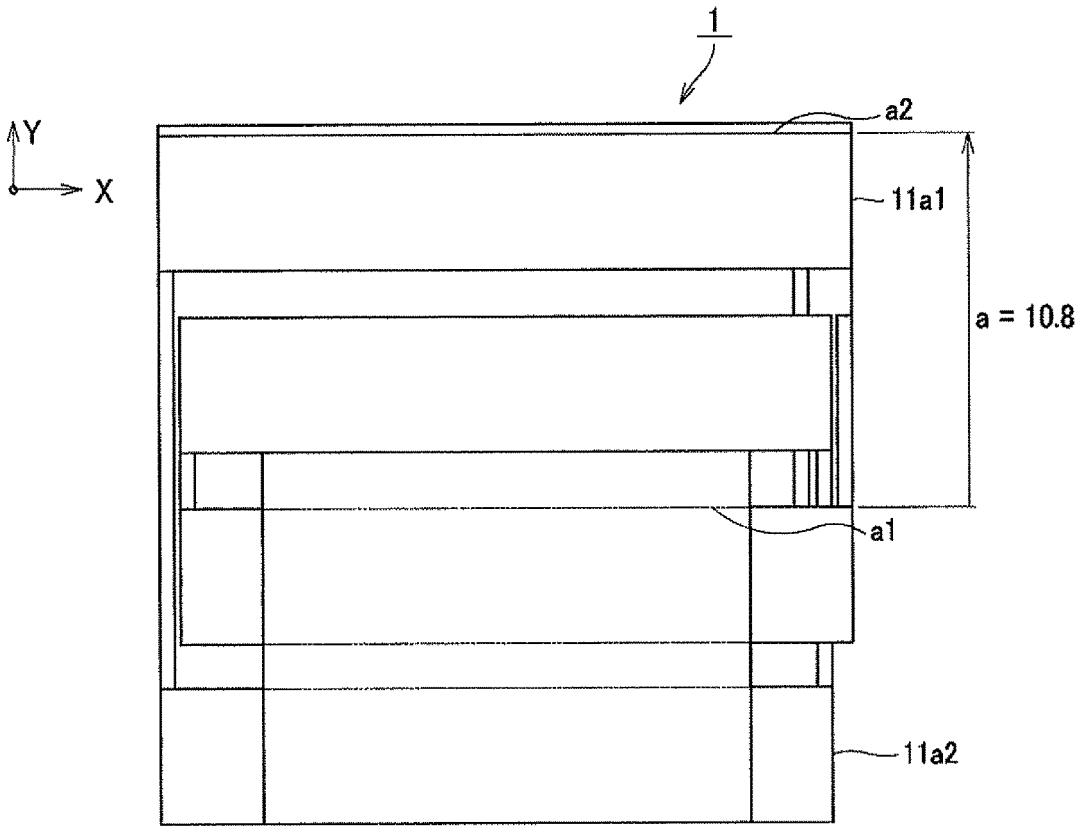
FIGS. 15A and 15B are diagrams for explaining a superimposing state in which the two coils are inserted into the magnetic coil sheet 13 such that the coils are almost completely superimposed on each other to coincide with each other when a=10.8 [mm].
Figure 15B:
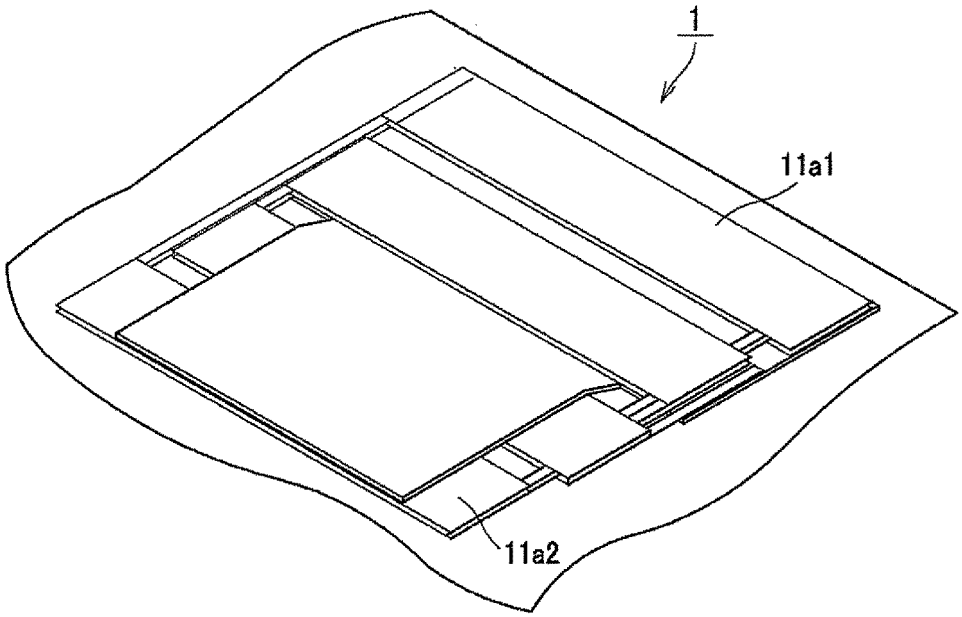

FIGS. 15A and 15B are a plan view and a perspective view showing the coils 11*a*1 and 11*a*2 that are inserted into the magnetic sheet 13 such that, when a=10.8 [mm], the coils 11*a*1 and 11*a*2 are almost completely superimposed on each other to coincide with each other.

Figure 16:
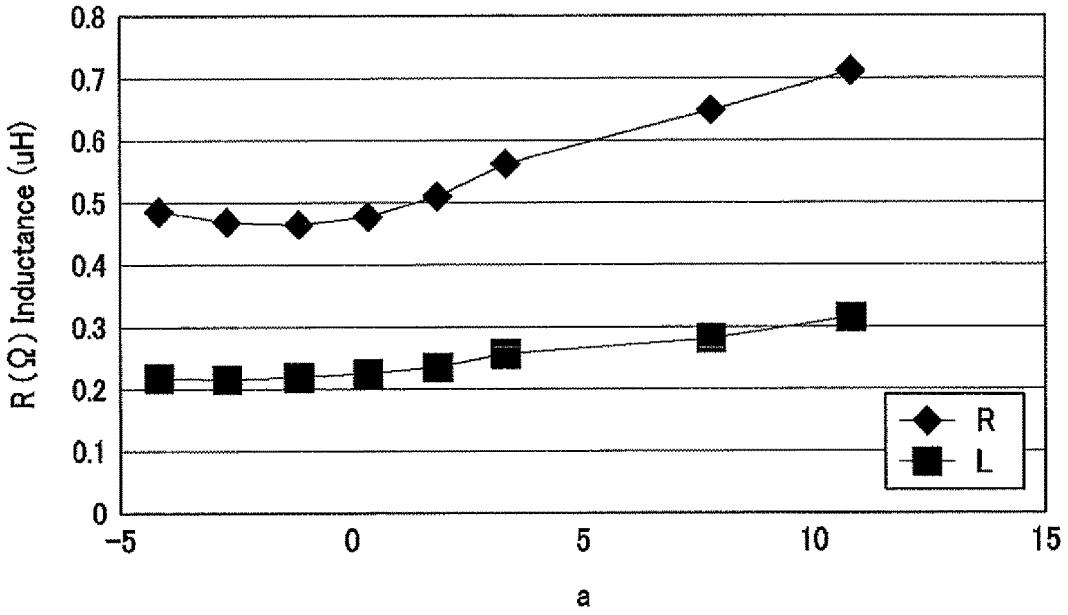
FIG. 16 is a diagram showing changes in resistance and inductance obtained when superimposing states between the two coils are changed by changing a value a [mm].

FIG. 16 shows a change of a resistance R and a change of a inductance L when superimposing states between the coils 11*a*1 and 11*a*2 are changed by changing a value a [mm].

As is apparent from FIG. 16, when the value a becomes positive, i.e., when superimposed regions of the outer shapes of the coils 11*a*1 and 11*a*2 are larger than the almost ½ regions, the inductance L is almost constant, but the resistance increases.

When the superimposed regions of the outer shapes of the coils 11*a*1 and 11*a*2 are larger than the almost ½ regions, a part of the conductive line of the coil 11*a*2 in which the magnetic sheet 13 is arranged on the circuit board 132 side and a part of the conductive line of the coil 11*a*1 arranged to be closer to the circuit board 132 side than the magnetic sheet 13 are superimposed on each other without through the magnetic sheet 13. For this reason, since a current is difficult to flow due to a proximity effect between the conductive lines, the resistance increases.

In contrast to this, when a part of the conductive line of the coil 11*a*2 in which the magnetic sheet 13 is arranged on the circuit board 132 side and a part of the conductive line of the coil 11*a*1 arranged to be closer to the circuit board 132 side than the magnetic sheet 13 are superimposed through the magnetic sheet 13, the action that makes the flow of current difficult does not occur. This is because an electromagnetic waves generated by the conductive lines are absorbed by the magnetic sheet 13.

Figure 17:
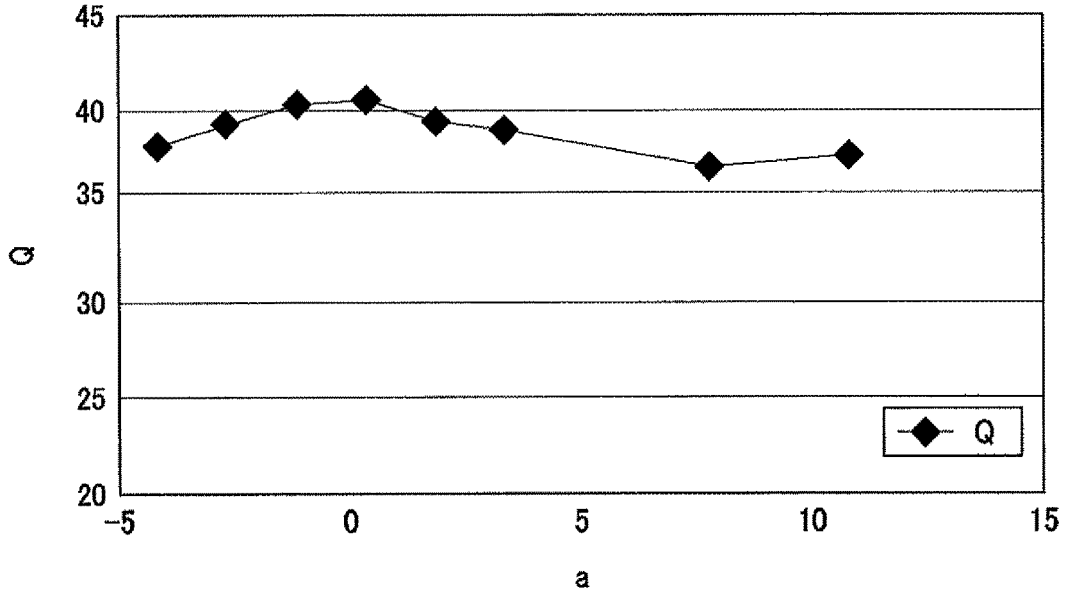
FIG. 17 is a diagram showing a change in Q value when superimposing states between the two coils are changed.
Figure 18:
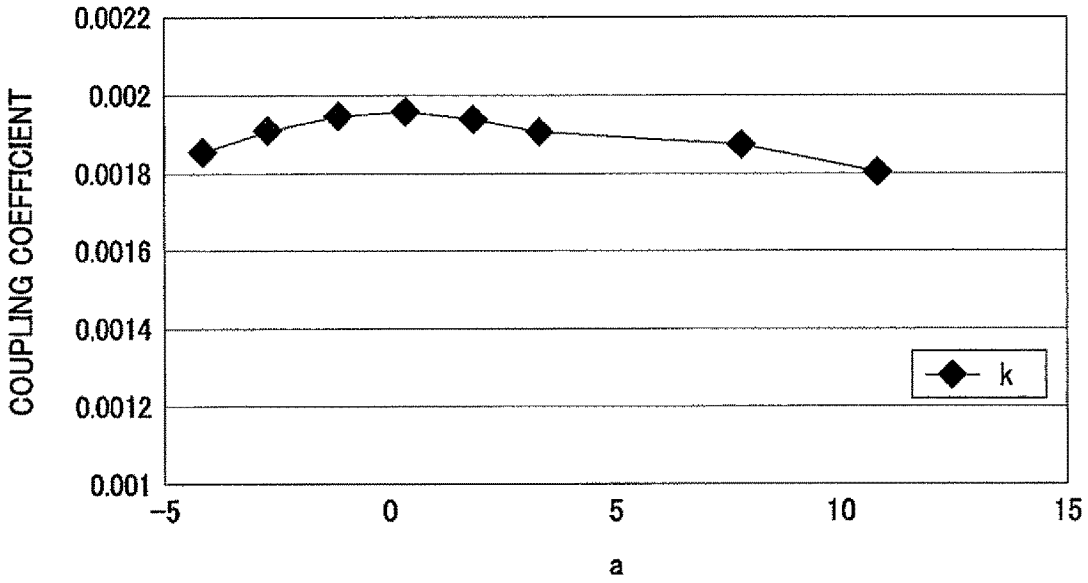
FIG. 18 is a graph showing a change in coupling coefficient between a reader-writer and the antenna when superimposing states between the two coils are changed by changing the value a [mm].

FIGS. 17 and 18 show a change in Q value and a change of a coupling coefficient k between the reader-writer 120 and the antenna 121 when the superimposing states between the coils 11*a*1 and 11*a*2 are changed by changing the value a [mm], respectively.

As is apparent from FIG. 16 to FIG. 18, regions that are smaller than the almost ½ regions of the coils 11*a*1 and 11*a*2 are preferably superimposed on each other in terms of communication characteristics.

In other words, in the communication device 1, a part of the conductive line of the coil 11*a*2 in which the magnetic sheet 13 is arranged on the circuit board 132 side and a part of the conductive line of the coil 11*a*1 arranged to be closer to the circuit board 132 side than the magnetic sheet 13 are superimposed through the magnetic sheet 13 to reduce a resistance and to realize a high Q value. For this reason, the communication device 1 is preferable in terms of communication characteristics. In particular, in terms of a reduction of an outer shape while realizing a high Q value, the coils 11*a*1 and 11*a*2 are preferably inserted into the magnetic sheet 13 such that a=0 [mm] is satisfied, i.e., almost ½ regions of the coils 11*a*1 and 11*a*2 are superimposed on each other.

Figure 19A:
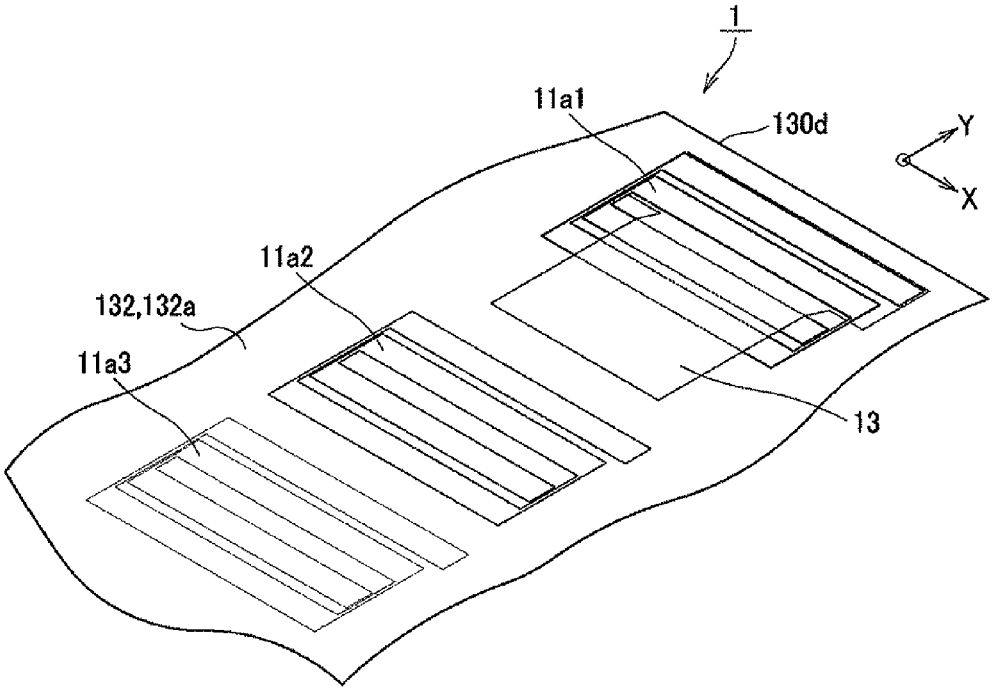
FIGS. 19A and 19B are diagrams for explaining a modification of the communication device according to the first embodiment.
Figure 19B:
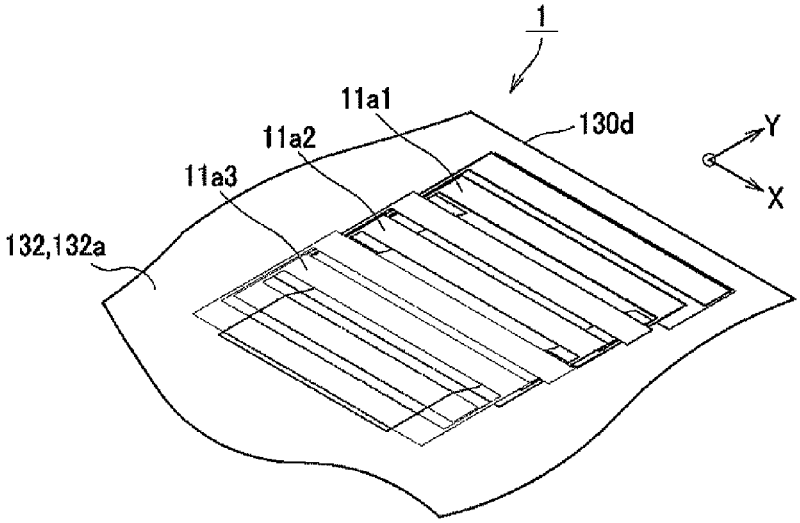

In the communication device 1 according to the first embodiment, although the two coils 11*a*1 and 11*a*2 are used, two or more coils may be used. For example, as shown in FIGS. 19A and 19B, three coils 11*a*1, 11*a*2, and 11*a*3 may be inserted into the magnetic sheet 13. In this manner, improved communication characteristics can be realized by an increase in inductance by increasing the number of turns while suppressing the resistance from increasing as much as possible.

Second Embodiment

A configuration of a communication device according to the second embodiment will be concretely described below with reference to FIGS. 20 to 23.

Figure 20:
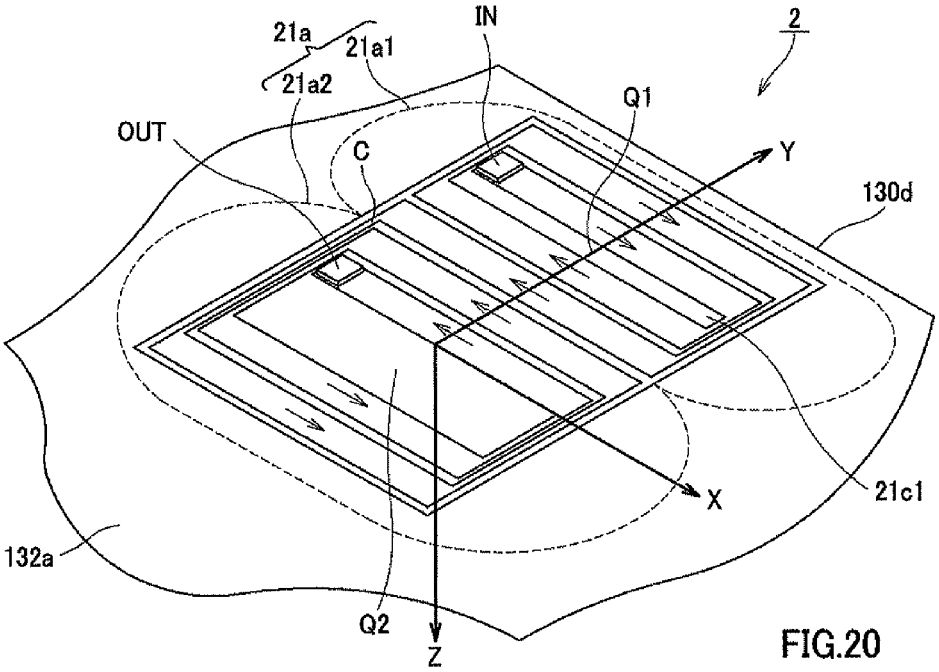
FIG. 20 is a diagram for explaining a configuration of a communication device according to a second embodiment, and is a perspective view showing a state in which an antenna circuit board that has been not assembled is developed.

A communication device 2 according to the second embodiment, for example, as shown in FIG. 20, is formed on an antenna circuit board 21 configured by one printed-circuit board, and has an antenna coil 21*a* in which two coils 21*a*1 and 21*a*2 winded in opposite directions are connected to each other by a contact point C. In this case, to wind the coils 21*a*1 and 21*a*2 the opposite directions, more specifically, as shown in FIG. 20, is that, when a current is caused to flow from an input terminal IN of the coil 21*a*1 to an output terminal OUT of the coil 21*a*2 through the contact point C, a direction of a current in the coil 21*a*1 having a center Q1 and a direction of a current in the coil 21*a*2 having a center Q2 are opposite to each other. Central points of the coils 21*a*1 and 21*a*2 are defined as cores Q1 and Q2, respectively.

Figure 21:
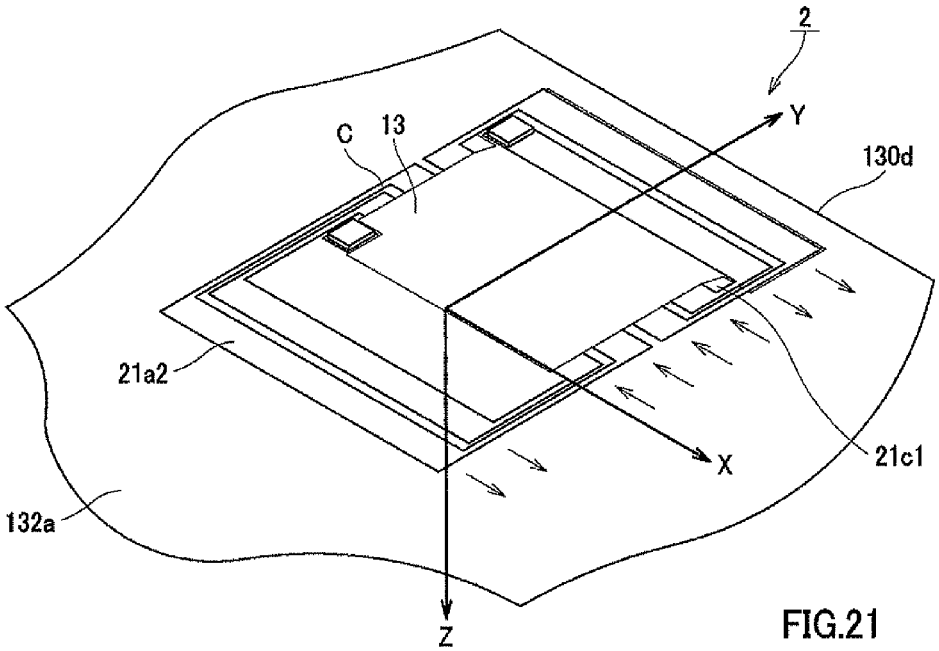
FIG. 21 is a diagram for explaining the configuration of the communication device according to the second embodiment, and is a perspective view showing a state in which a magnetic sheet is mounted on an antenna circuit board.

In the communication device 2 having the antenna coil 21*a*, first, as shown in FIG. 21, the coil 21*a*1 is arranged to be closer to the outer peripheral side 130*d* of the circuit board 132 than the coil 21*a*2. On the central part 132*a* side of the circuit board 132, an opening 21*c*1 of the coil 21*a*1 is inserted into the magnetic sheet 13. The coil 21*a*1 is arranged to be closer than the circuit board 132 than the magnetic sheet 13. On the outer peripheral side 130*d* side of the circuit board 132, the magnetic sheet 13 is arranged to be closer to the circuit board 132 than the coil 21*a*1.

Figure 22:
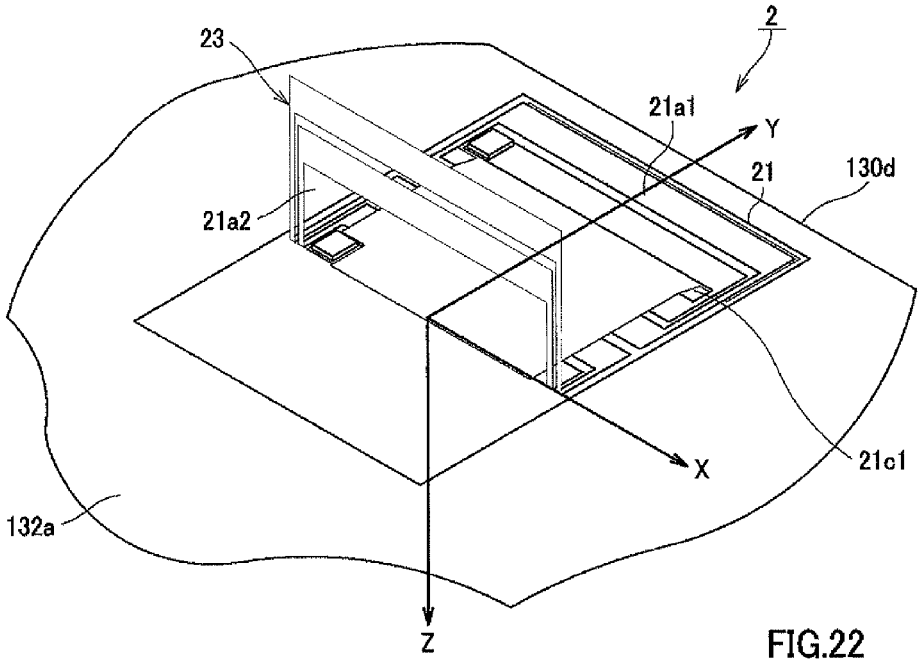
FIG. 22 is a diagram for explaining the configuration of the communication device according to the second embodiment, and is a perspective view showing a state in which the antenna circuit board is folded.
Figure 23:
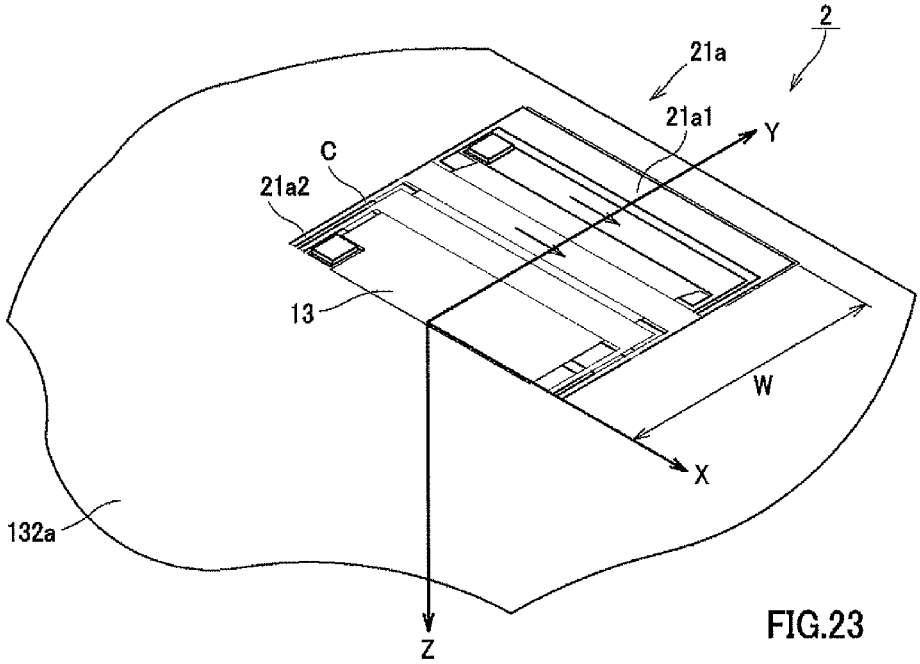
FIG. 23 is a diagram for explaining the configuration of the communication device according to the second embodiment, and is a perspective view showing a state in which the antenna circuit board is folded back and is completed as a communication device.

In the communication device 2, as shown in FIG. 21, a magnetic sheet is inserted into the opening 21*c*1 of the coil 21*a*1. As shown in FIG. 22, of the coil 21*a*2, with reference to an opening 21*c*2 of the coil 21*a*2, a conductive line part 23 located on the central part 132*a* of the circuit board 132 is folded in a y-axis direction, i.e., on the outer peripheral side 130*d* side of the circuit board 132. By the folding, in the communication device 2, as shown in FIG. 23, the conductive line part 23 located on the central part 132*a* side of the circuit board 132 and the conductive line of the coil 21*a*1 are superimposed in a direction orthogonal to the circuit board 132.

Figure 24:
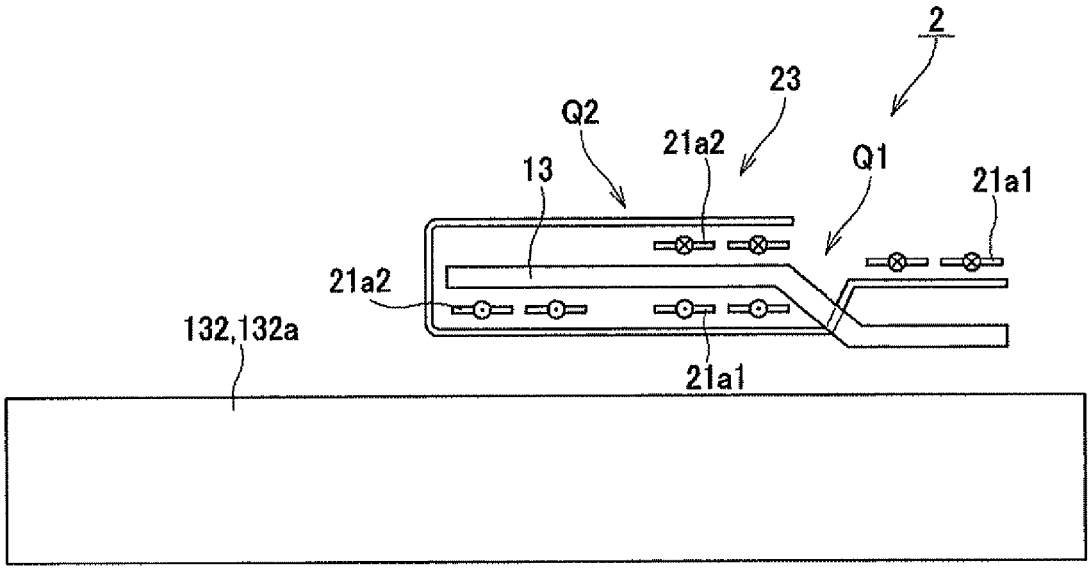
FIG. 24 is a diagram for explaining the configuration of the communication device according to the second embodiment, and is a diagram typically showing a state in which the communication device is mounted on a circuit board in a mobile phone.

In this manner, in the communication device 2, as shown in FIG. 24, the coil 21*a*2 is folded to cause the winding directions of the coil 21*a*2 and the coil 21*a*1 to be identical with each other. A part of the conductive line in which the magnetic sheet 13 is arranged on the circuit board 132 side and a part of the conductive line of the coil 21*a*1 arranged to be closer to the circuit board 132 side than the magnetic sheet 13 are superimposed through the magnetic sheet 13.

In this case, a characteristic change obtained when a width W of the antenna coil 21*a* regulated in a y-axis direction of the circuit board 132 will be described with reference to FIG. 25.

Figure 25:
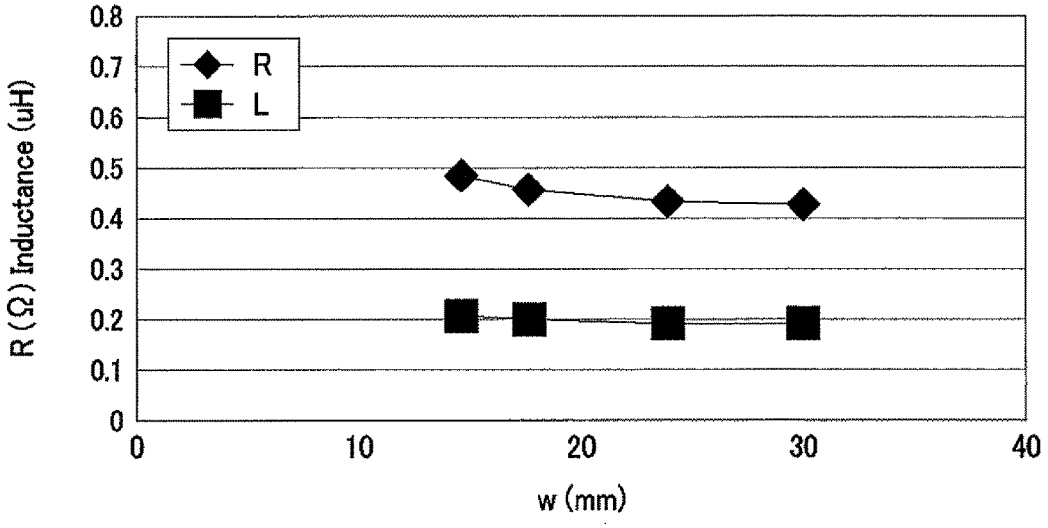
FIG. 25 is a diagram for explaining a change of characteristics when a width W of an antenna coil regulated in a y-axis direction is changed in the second embodiment and a comparative example.

FIG. 25 is a diagram showing a resistance R and an inductance L obtained when the width W of the antenna coil 21*a* regulated in the y-axis direction of the circuit board 132. As is apparent from FIG. 25, the characteristics of the antenna coil 21*a* rarely change depending on the width W.

Under the condition in which an outer shape and the number of turns of the antenna coil 21*a* regulated on an x-y plane of the circuit board 132 are constant, performances of the antenna coil 21*a* of the communication device 2 and the antenna coil 211*a* of the communication device 201 according to the comparative example will be evaluated.

Figure 26:
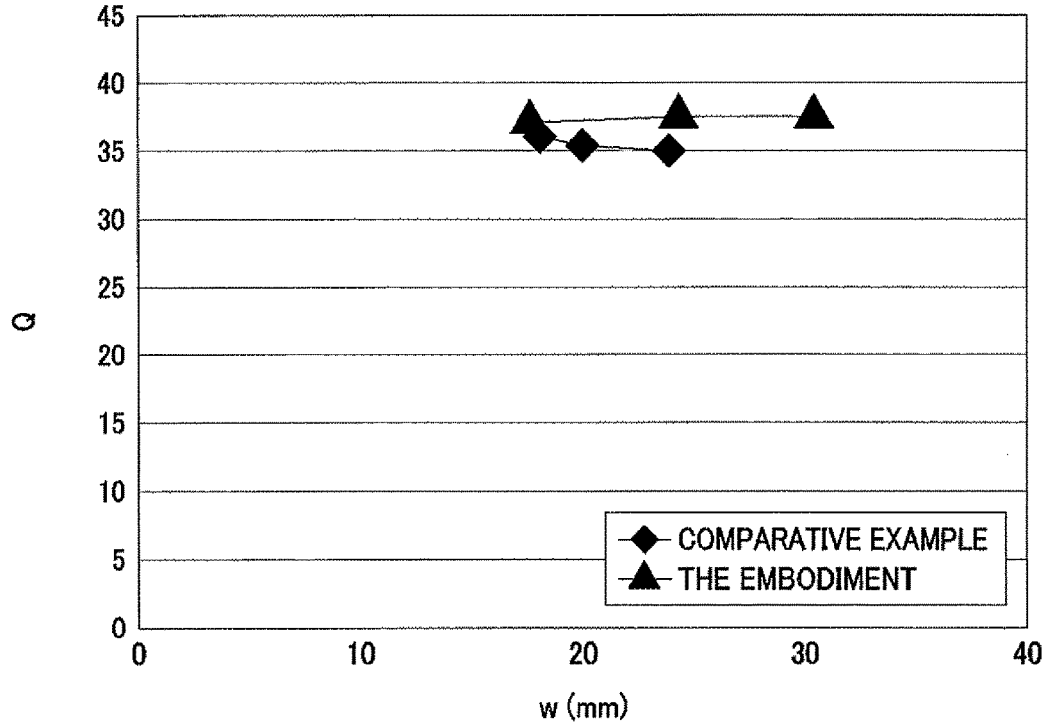
FIG. 26 is a graph showing a change in Q value of the antenna coil when the width w of the antenna coil regulated in the y-axis direction is changed in the second embodiment and the comparative example.
Figure 27:
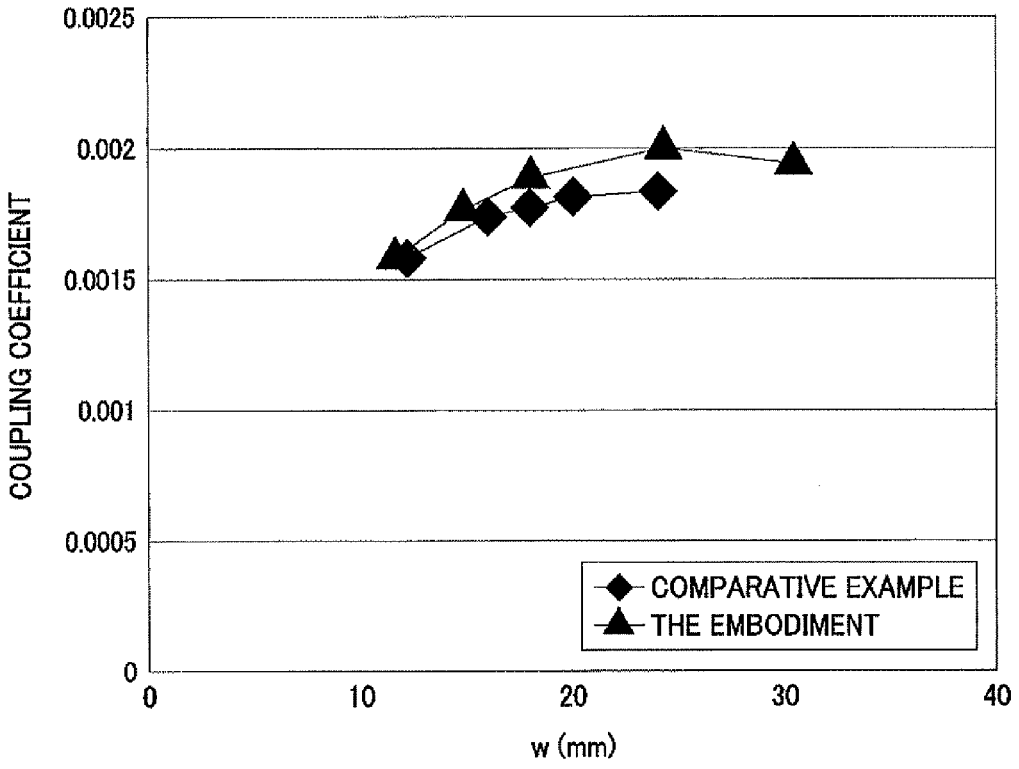
FIG. 27 is a graph showing a change in coupling coefficient between a reader-writer and an antenna when the width w of the antenna coil regulated in the y-axis direction is changed in the second embodiment and the comparative example.

FIG. 26 is a graph showing changes in Q value of the antenna coils 21*a* and 211*a* obtained when the width W of the antenna coil regulated in the y-axis direction of the circuit board 132. FIG. 27 is a graph showing a change of a coupling coefficient k between the reader-writer 120 and the antenna 121 obtained when the width W of the antenna coils 21*a* and 211*a* regulated in the y-axis direction of the circuit board 132.

As is apparent from the results in FIGS. 26 and 27, in comparison with the communication device 201 according to the comparative example, in the communication device 2, the line width of the coil can be averagely widened, and a resistance can be reduced. For this reason, the Q value can be made high, and the coupling coefficient can be made high. As a result, the communication characteristics can be improved.

In the communication device 2 having the above configuration, the magnetic sheet 13 is arranged such that a part of the conductive line of the coil 21*a*2 in which the magnetic sheet 13 is arranged on the circuit board 132 side and a part of the conductive line of the coil 21*a*1 arranged to be closer to the circuit board 132 side than the magnetic sheet 13 are superimposed in a direction orthogonal to the circuit board 132. In this manner, the number of turns can be increased without narrowing the line width of the conductive line. In particular, in the communication device 2, the above superimposing structure can be realized by using the two coils 21*a*1 and 21*a*1 that are formed on the antenna circuit board 21 configured by one printed-circuit board and winded in opposite directions through the contact point C. For this reason, the communication device 2 can is preferable because the antenna coil can be more easily formed than the antenna coil 11*a* of the communication device 1 according to the first embodiment. In this manner, in the second embodiment, since the number of turns of the antenna coil 21*a* can be increased while suppressing an increase in resistance depending on the line width of the conductive line and an increase in coil area in the planar direction of the circuit board 132, improved communication characteristics can be realized.

In the communication device 2, a part of the conductive line of the coil 21*a*2 in which the magnetic sheet 13 is arranged on the circuit board 132 side and a part of the conductive line of the coil 21*a*1 that is arranged to be closer to the circuit board 132 side than the magnetic sheet 13 and folded need only be arranged to be superimposed in a direction orthogonal to the circuit board 132. In particular, for example, as shown in FIG. 28A, the coil 21*a*1 and the folded coil 21*a*2 are preferably arranged such that half regions of the outer shapes regulated in the planar direction of the circuit board 132 are superimposed on each other.

In this case, as shown in FIG. 28, the outer shape of the antenna coil 21*a* regulated by the width W an the length L are set to be constant, i.e., 20 mm and 20 mm, respectively. As will be described below, a superimposing position between the coils 21*a*1 and 21*a*2 is expressed with a value b [mm] regulated in a direction regulated by a W direction. More specifically, in the opening 21*c*1 of the coil 21*a*1, a length b from an end side b1 on the central part 132*a* side to an end side b2 of the conductive line part 23 of the coil 21*a*2 is defined as b [mm].

Figure 28A:
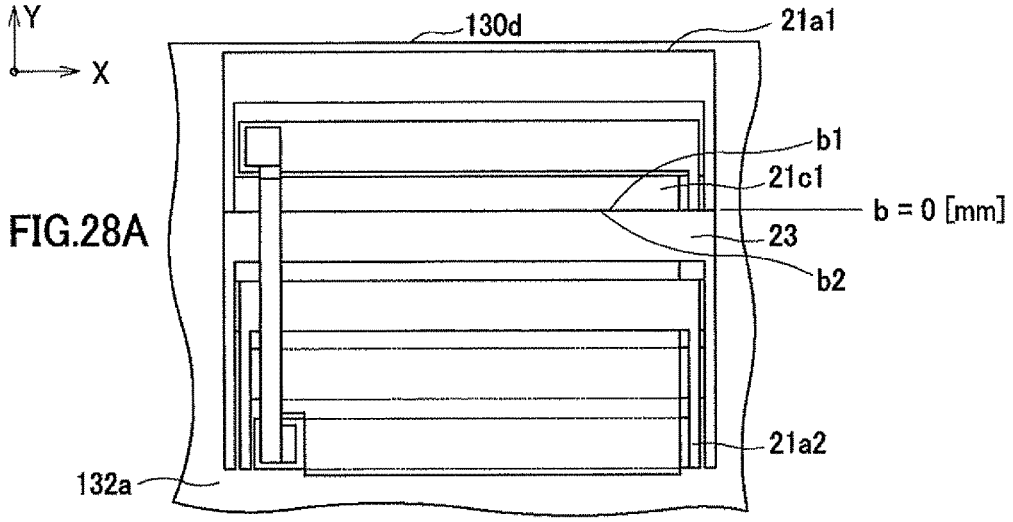
FIGS. 28A to 28C are plan views the communication device to explain a value b that regulates a superimposing state of two coils configuring the antenna coil under the condition in which outside dimensions of the antenna coil regulated by a width W and a length L are set to be constant, i.e., 20 mm and 20 mm, respectively, in the second embodiment.

FIG. 28A shows that the value b is 0 [mm] and the end side b1 and the end side b2 are identical with each other in a direction of thickness. In other words, this state is a state in which half regions of the coils are superimposed on each other in a shape in which the coil 21*a*1 and the coil 21*a*2 obtained in the folding are regulated in the planar direction of the circuit board 132.

Figure 28B:
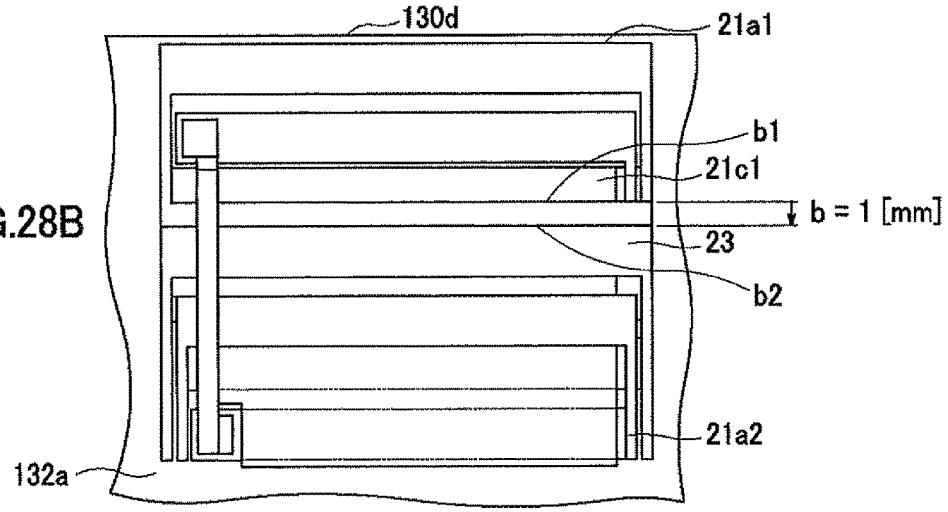

FIG. 28B shows a state in which, when the value b is 1 [mm], ¼ regions of the coil 21*a*1 and the coil 21*a*2 obtained in the folding are superimposed on each other in a direction orthogonal to the circuit board 132.

Figure 28C:
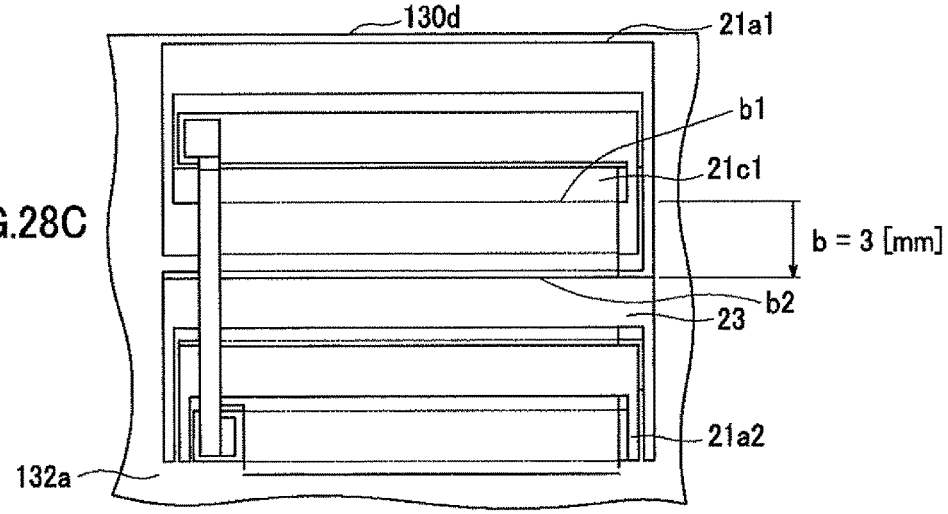

Furthermore, FIG. 28C shows a state in which, when the value b is 3 [mm] the coil 21*a*1 and the coil 21*a*2 obtained in the folding are superimposed in a direction orthogonal to the circuit board 132. In other words, ¼ regions of the coil 21*a*1 and the coil 21*a*2 obtained in the folding are superimposed on each other in a shape regulated in a planar direction of the circuit board 132.

Figure 29:
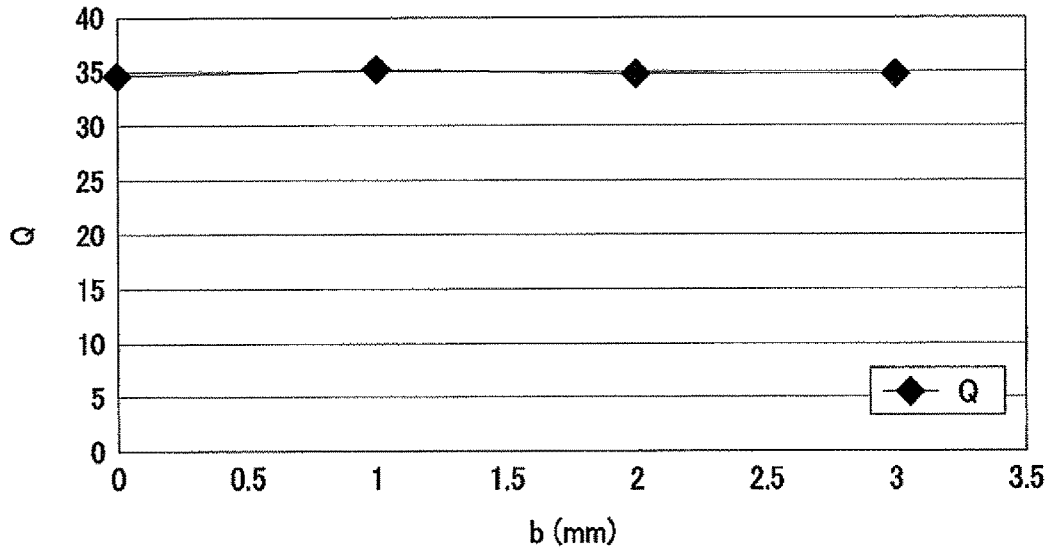
FIG. 29 is a graph showing a change in Q value when superimposing states between the two coils are changed by changing a value b [mm].
Figure 30:
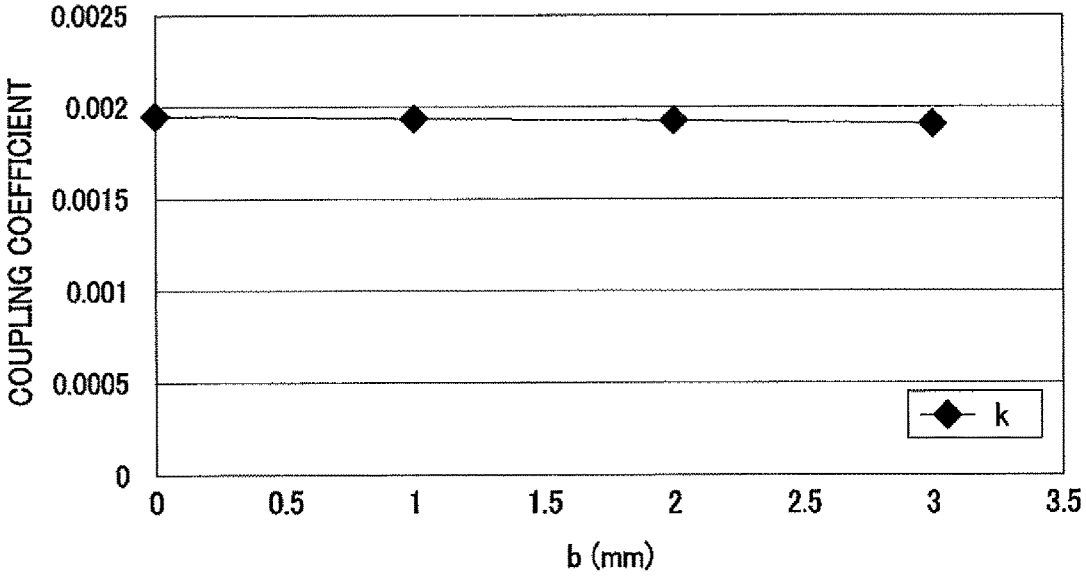
FIG. 30 is a graph showing a change in coupling coefficient between a reader-writer and an antenna when superimposing states of the two coils are changed by changing the value b [mm].

FIGS. 29 and 30 show a change in Q value and a coupling coefficient k between the reader-writer 120 and the antenna 121 when a superimposing state between the coils 21*a*1 and 21*a*2 is changed by changing the value b [mm], respectively.

According to the results in FIGS. 29 and 30, when the superimposed regions of the outer shapes of the coils 21*a*1 and 21*a*2 are almost ½ or less, the communication characteristics rarely change.

Modification of Second Embodiment

As a request of an electronic device on which the antenna module according to the present invention is mounted, a reduction in size or thickness is generally given. However, when a thin magnetic sheet is used to cope with the reduction in thickness, desired magnetic characteristics may not be sufficiently exerted. In such a case, a magnetic sheet having a certain thickness must be used. However, in the configuration of the antenna module, when the thick magnetic sheet, an antenna circuit board must be largely folded, and the magnetic sheet must be inserted into an opening of the antenna circuit board. For this reason, the antenna module cannot be easily manufactured, and has poor mass productivity. The magnetic sheet includes a film-like base material on which a magnetic powder is applied and a magnetic sheet that is shaped into a plate-like sheet having a certain thickness by using, for example, a calcimining technique or the like.

Figure 31A:
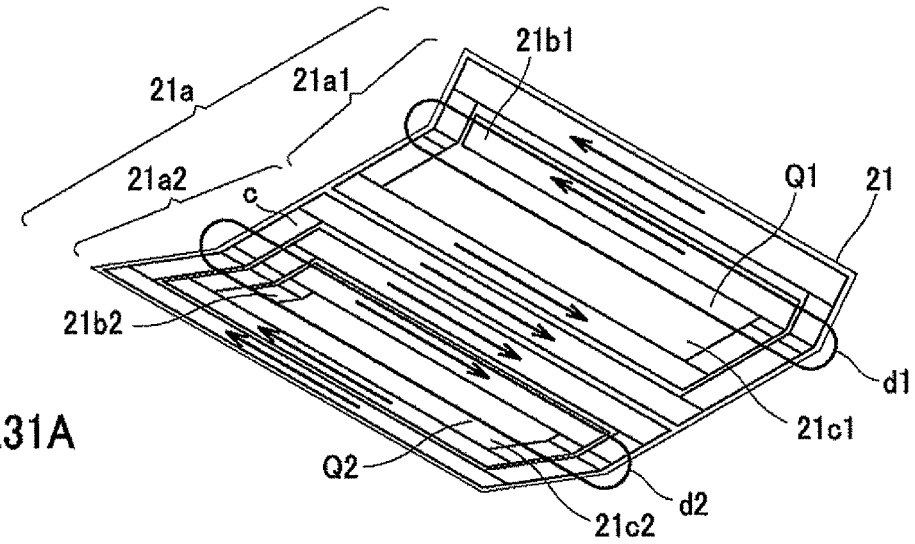
FIGS. 31A to 31C are diagrams for explaining a configuration of a modification of the second embodiment.
Figure 31B:
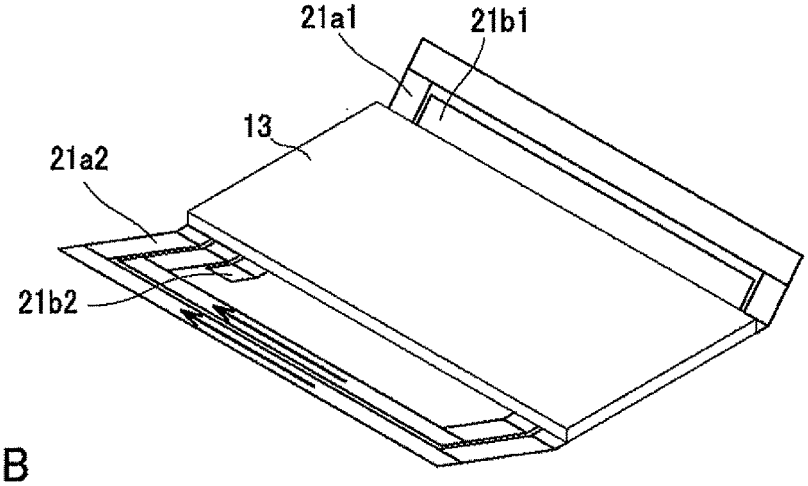
Figure 31C:
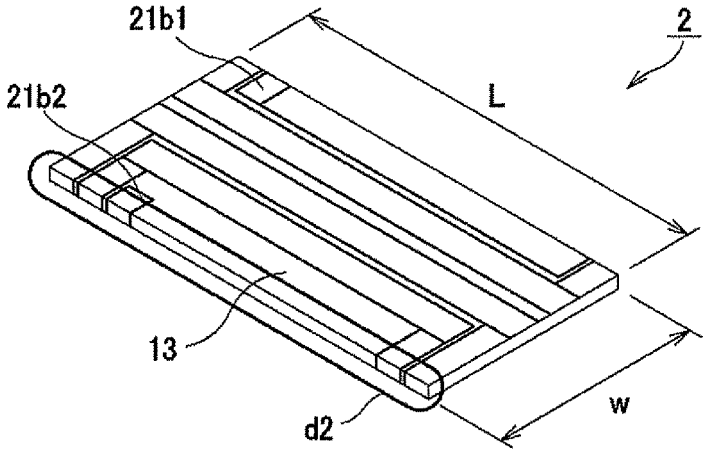

Thus, as shown in FIGS. 31A to 31C, a conductive line is formed on a flexible antenna circuit board such as a flexible printed-circuit board, and the antenna coil 21*a* obtained by connecting the coils 21*a*1 and 21*a*2 winded in opposite directions to the contact point C is used. The opening 21*c*1 is formed in the coil 21*a*1, and the center of the coil is a core Q1. Similarly, the opening 21*c*2 is formed in the coil 21*a*2, and the center of the coil is a core Q2. An open end of the conductive line of the coil 21*a*1 serves as a terminal 21*b*1, and an open end of the conductive line of the coil serves as a terminal 21*b*2. An arrow written in the conductive line indicates a direction of current at a certain instant. In this case, as shown in FIG. 31A, on the antenna circuit board 21, depending on the thickness of the magnetic sheet 13 when the magnetic sheet 13 is mounted, a bent part d1 of the coil 21*a*1 and a bent part d2 of the coil 21*a*2 are formed. The bent part d1 is arranged to have a length corresponding to the thickness of the magnetic sheet 13 from an edge on the outer peripheral side 130*d* side of the opening 21*c*2 of the coil 21*a*2 along the antenna circuit board 21. To wind the coils in opposite directions, as in the case in FIG. 20, is that, when a current is caused to flow from the terminal 21*b*1 serving as the input terminal of the coil 21*a*1 to the terminal 21*b*2 serving as an output terminal through the contact point C, a direction of current in the coil 21*a*1 having the core Q1 as its center is opposite to a direction of current flowing around the core Q2. In FIGS. 31B and 31C, in order to more clearly show the state of the antenna coil 21*a*, the antenna circuit board 21 is omitted.

The following configuration is formed by using the above antenna circuit board and the above magnetic sheet 13 to assemble the communication device 2.

As shown in FIG. 31B, the magnetic sheet 13 is mounted on the antenna coil 21*a* including the coils 21*a*1 and 21*a*2. A position where the magnetic sheet 13 is mounted is set to a position where one end side of the magnetic sheet 13 is brought into contact with the bent part d1. The magnetic sheet 13 is mounted such that the other end side of the magnetic sheet 13 is brought into contact with the bent part d2.

As shown in FIG. 31C, an end of the coil 21*a*1 on the outer peripheral side 130*d* side and an end of the coil 21*a*2 on the central part 132*a* side are folded along the bent parts d1 and d2, and the antenna circuit board 21 is folded to cover the upper surface of the magnetic sheet 13 so as to complete the communication device 2.

Figure 32:
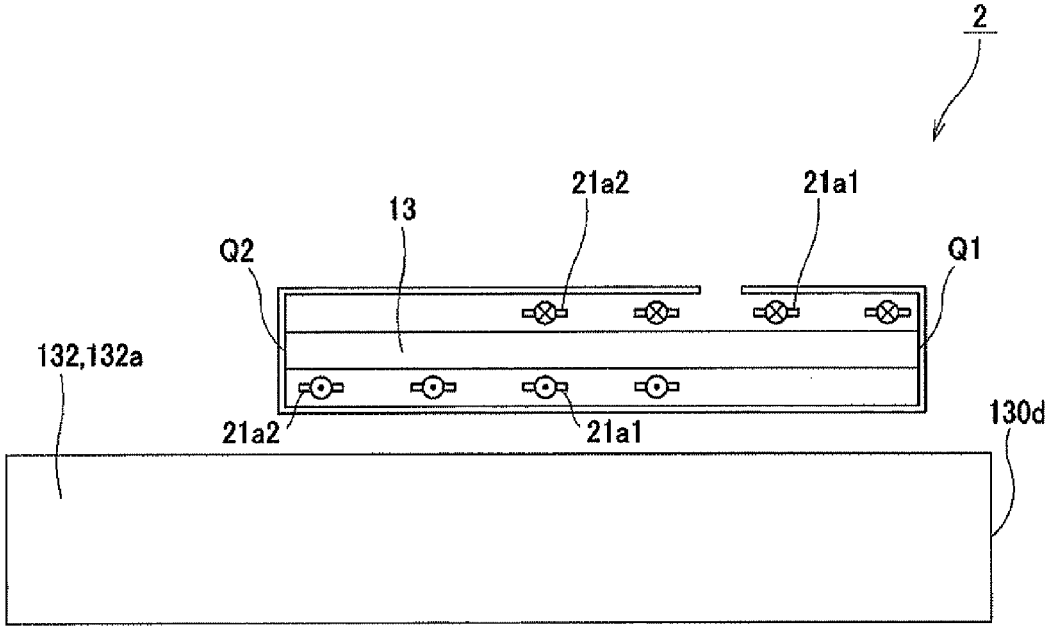
FIG. 32 is a diagram for explaining a configuration of the modification of the second embodiment, and a diagram typically showing a state in which the communication device is mounted on a circuit board in a mobile phone.

As shown in FIG. 32, in the communication device 2, the conductive line at an edge of the folded coil 21*a*1 is located to be closer to the reader-writer 120 than the magnetic sheet 13 on the outer peripheral side 130*d* side. On the central part 132*a* side of the circuit board 132, the magnetic sheet 13 is located to be closer to the reader-writer 120 than the conductive line of the coil 21*a*2. In this case, the conductive line on at an edge of the folded coil 21*a*2 is superimposed on the conductive line on the circuit board 132 side of the coil 21*a*1, and half regions of the conductive line on the reader-writer 120 side and the conductive line of the circuit board 132 side are preferably superimposed on each other in the planar direction of the circuit board 132.

Figure 33:
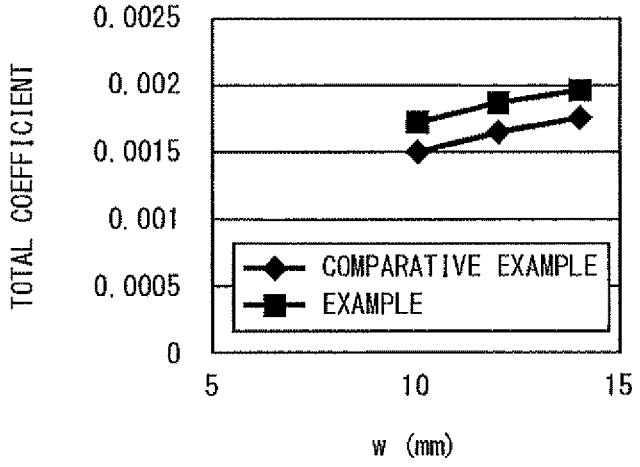
FIG. 33 is a graph showing a change in coupling coefficient between a reader-writer and an antenna when a width W of an antenna coil is changed in the modification of the second embodiment and a comparative example.
Figure 34:
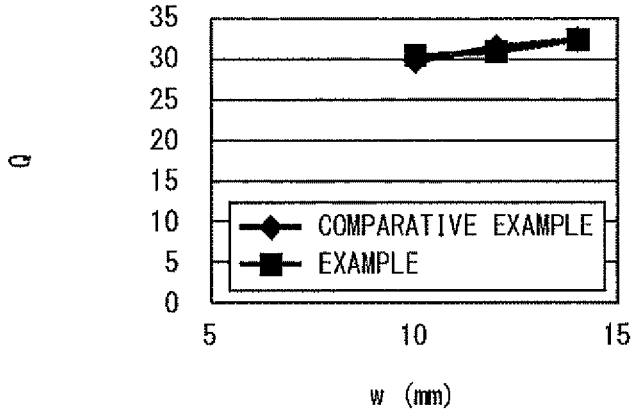
FIG. 34 is a graph showing a change in Q value of the antenna coil when the width W of the antenna coil is changed in the modification of the second embodiment and the comparative example.

FIGS. 33 and 34 show results obtained by evaluating communication characteristics of the communication device 2 when the width W of the communication device in FIG. 31C is changed. FIG. 33 shows a change in coupling coefficient for the width W of the communication device 2 in comparison with the communication device 201 according to the comparative example. It is understood that, even though the width W is arbitrarily set, preferable coupling coefficients can be obtained in comparison with the communication device 201 according to the comparative example. FIG. 34 shows a change in Q value for the width W in comparison with the communication device 201 according to the comparative example. It is shown that the Q value is constant even though the width W is arbitrarily set. As a result, the communication device 2 can obtain communication characteristics that are better than those of the communication device 201.

Figure 35A:
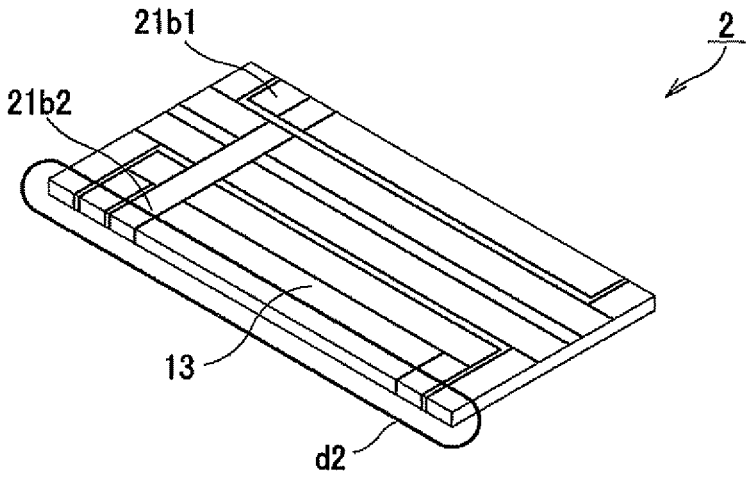
FIGS. 35A and 35B are diagrams showing variations of the communication device according to the modification of the second embodiment.
Figure 35B:
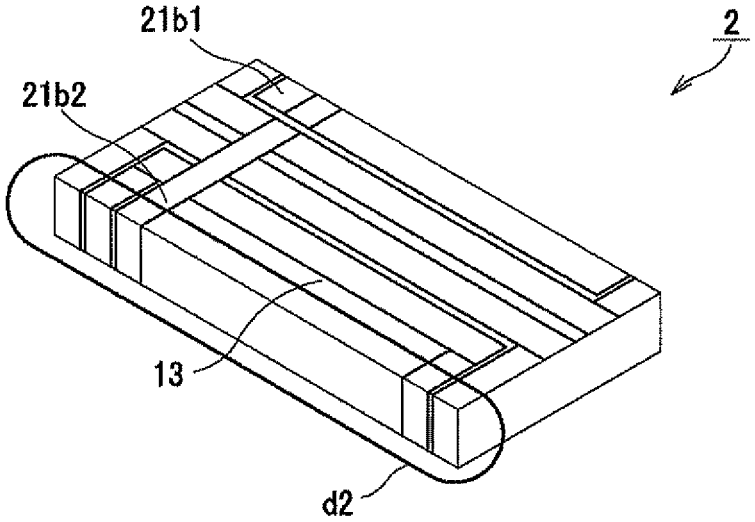

As shown in FIG. 35A, the bent parts d1 and d2 are appropriately set to make it possible to use a magnetic sheet having a larger thickness, for example, a thickness of 1 mm. As shown in FIG. 35B, when the bent parts d1 and d2 are further enlarged, a magnetic sheet having a further larger thickness, for example, a thickness of 3 mm.

In the modification, when the antenna circuit board 21 on which the conductive line of the antenna coil 21*a* is arranged is folded depending on the thickness of the magnetic sheet 13, the antenna circuit board 21 need not be bent to have a curved surface. For this reason, on the printed-circuit board, notches or the like are formed in bent portions of the bent parts d1 and d2 to make it possible to use not only a flexible printed-circuit board but also a rigid circuit board. Since the bent parts d1 and d2 can be used to position the magnetic sheet 13, automation can be employed to make manufacturing steps easy. When the size of the antenna circuit board 21 is set to be larger than that of the magnetic sheet 13, the magnetic sheet 13 can be completely enwrapped with the antenna circuit board 21. As a material of the antenna circuit board 21, a flexible plastic material such as polyimide and PET is used to make it possible to seal the magnetic sheet 13 inside the antenna circuit board 21. In particular, when a ceramic material such as ferrite is used as a magnetic material, ceramic powder can be prevented from falling when the communication device 2 according to the present invention is mounted in an electronic device.

Figure 36A:
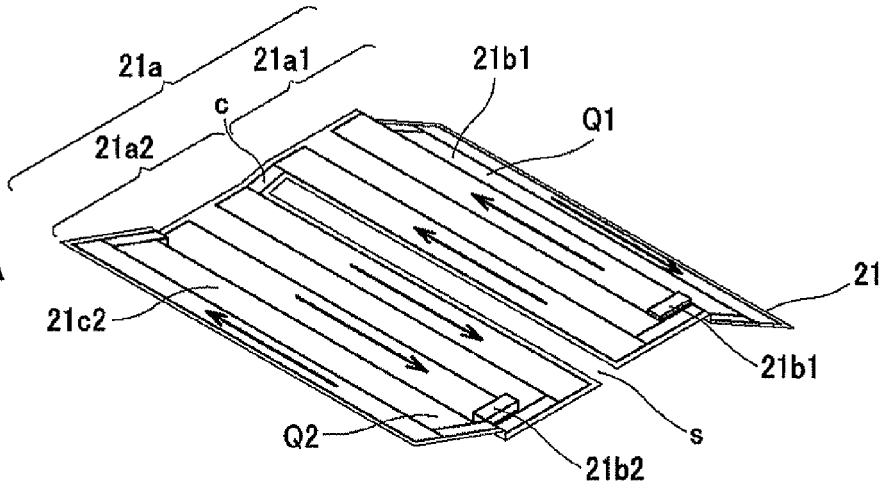
FIGS. 36A to 36C are diagrams for explaining another modification of the second embodiment.
Figure 36B:
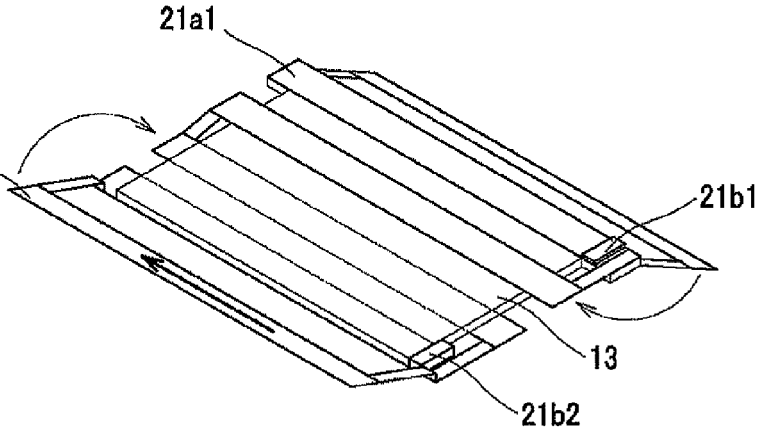
Figure 36C:
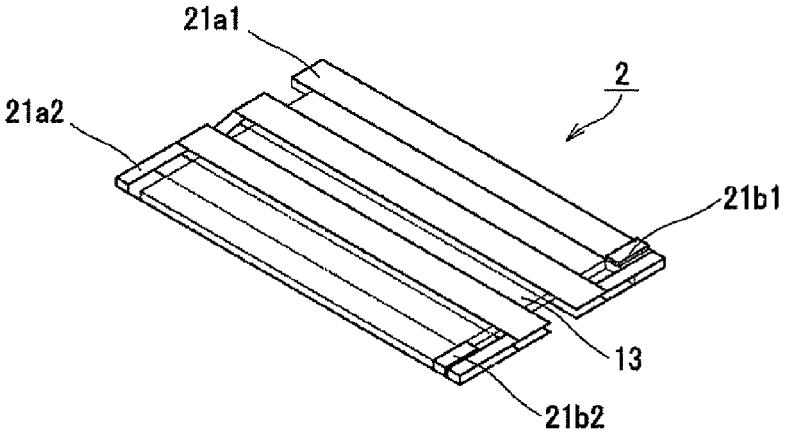

Furthermore, as another modification, as shown in FIG. 36, a conductive line configuring the antenna coil 21*a* is formed on the antenna circuit board 21, and the coils 21*a*1 and 21*a*2 winded in opposite directions are connected to the contact point C to form the communication device. A slit s into which the magnetic sheet is inserted is formed between the coils 21*a*1 and 21*a*2. In the configuration as shown in FIG. 31, the communication device is configured such that both the ends of the antenna circuit board 21 are folded back in the same direction to enwrap a magnetic material. In contrast to this, the configuration is different from that in the embodiment in that, as shown in FIG. 36B, both the ends of the antenna circuit board 21 are folded back in vertically opposite direction to configure the communication device 2. In FIGS. 36B and 36C (will be described later), in order to more clearly show the state of the antenna coil 21*a*, the antenna circuit board 21 is omitted.

As shown in FIG. 36, the coil 21*a*1 is mounted on the magnetic sheet 13 to cover an almost ½ region of the magnetic sheet 13, the magnetic sheet 13 is inserted into the slit, and the coil 21*a*2 is mounted on a lower part of the remaining ½ region of the magnetic sheet 13.

As shown in FIG. 36C, an end of the coil 21*a*1 is folded downward to be superimposed on the lower surface of the magnetic sheet 13 in parallel with each other. An end of the coil 21*a*2 is folded upward to be superimposed on the upper surface of the magnetic sheet 13 in parallel with each other.

In the modification, as the magnetic sheet, a magnetic sheet having a certain thickness may be used.

The coil 21*a*1 and the coil 21*a*2 are formed on different printed-circuit boards, respectively, and the coil 21*a*1 is placed on the upper surface of the magnetic sheet 13. Thereafter, an end of the coil 21*a*1 is folded downward, the coil 21*a*2 is placed on the lower surface of the magnetic sheet, and an end of the coil 21*a*2 is folded upward. Thereafter, the coil 21*a*1 and the coil 21*a*2 may be connected to the connection point C.

Figure 37:
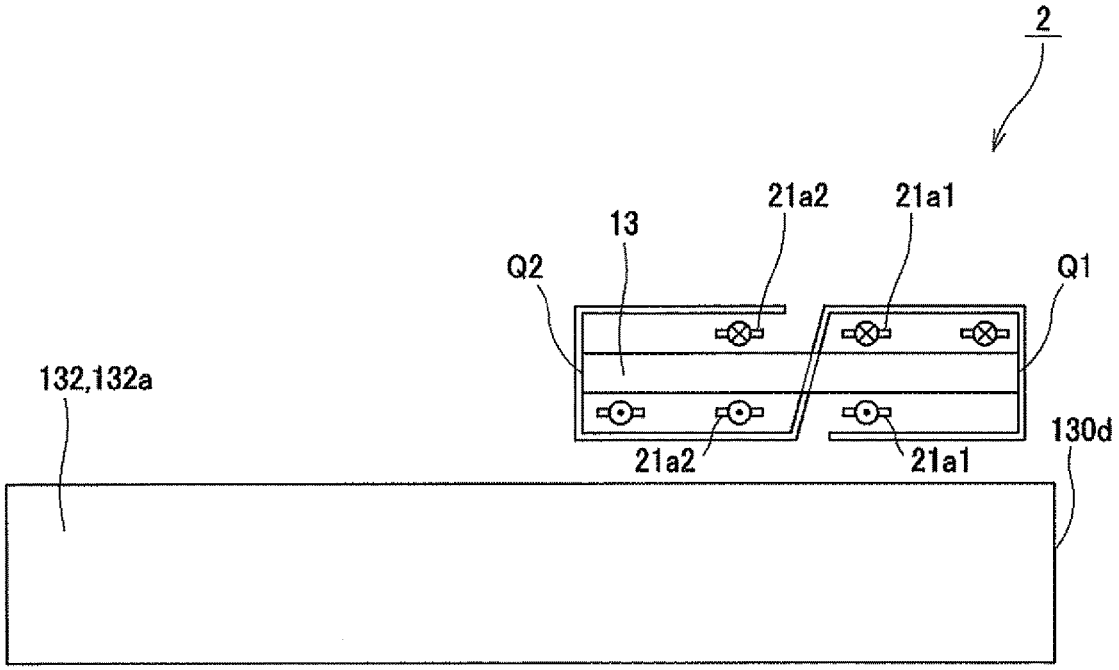
FIG. 37 is a diagram for explaining a configuration of another modification of the second embodiment, and a diagram typically showing a state in which a communication device is mounted on a circuit board in a mobile phone.

As shown in FIG. 37, in the communication device 2, a conductive line at an end of the coil 21*a*1 folded on the circuit board 132 side is located to be closer to the circuit board 132 than the magnetic sheet 13 on the outer peripheral side 130*d* side. On the central part 132*a* side, a conductive line at an end of the coil 21*a*2 folded on the reader-writer 120 side is located to be closer to the reader-writer 120 side than the magnetic sheet 13. In this case, a conductive line at an end of the folded coil 21*a*2 is superimposed on the conductive line on the circuit board 132 side of the coil 21*a*1, and the conductive line on the reader-writer 120 side and the conductive line on the circuit board 132 side are preferably arranged such that the half regions of the conductive lines are superimposed in the planar direction of the circuit board 132.

In the modification, since a conductor pattern of the antenna coil 21*a* obtained when the antenna circuit board 21 is developed and the folding position of the antenna circuit board 21 can be axisymmetrical about the contact point C and the slit s, pattern design and circuit board design can be easily performed. For this reason, the manufacturing step can be simplified.

Third Embodiment

A printed-circuit board and a magnetic sheet that form an antenna coil are laminated to make it possible to simplify manufacturing steps.

Figure 38A:
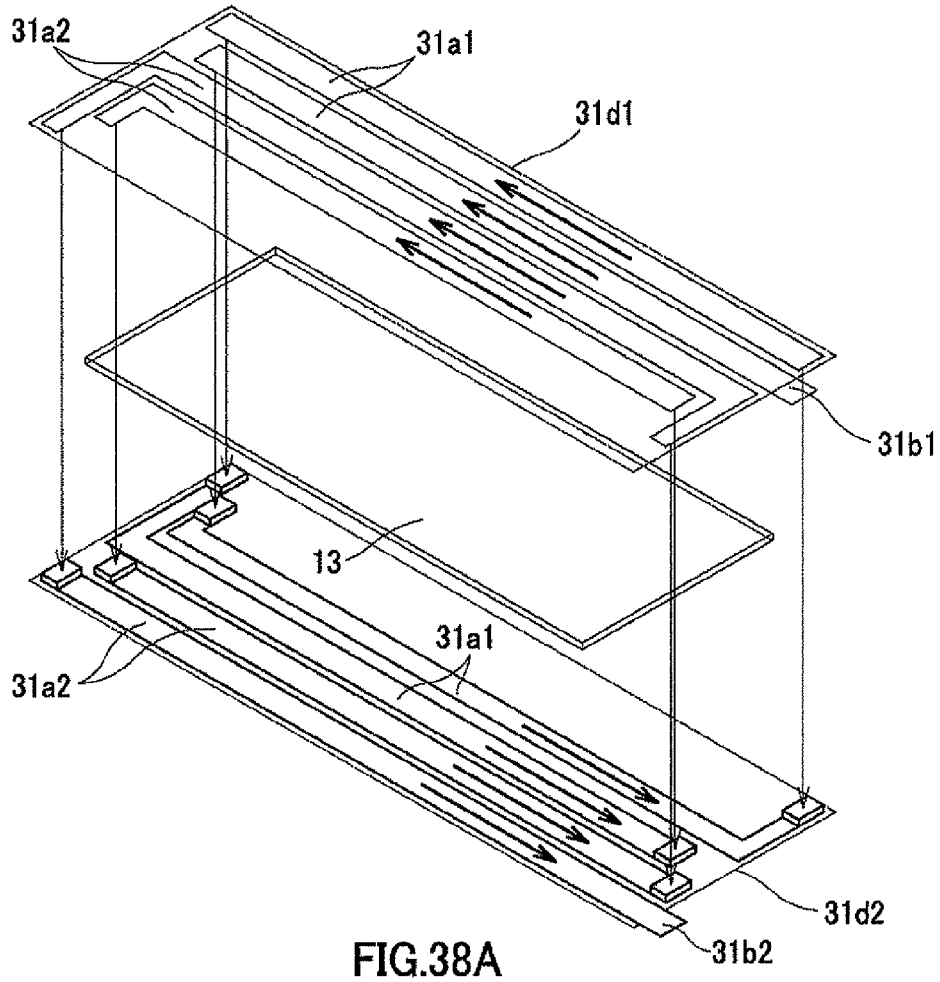
FIGS. 38A and 38B are diagrams for explaining a third embodiment.

As shown in FIG. 38A, on a printed-circuit board 31*d*1, a part of a coil 31*a*1 and a part of a coil 31*a*2 are formed. For example, a conductive line to be arranged to be closer to the outer peripheral side 130*d* on a housing surface is a part of the coil 31*a*1, and a conductive line to be arranged to be closer to the central part 132*a* configures the coil 31*a*2. On a second printed-circuit board 31*d*2, a part of the coil 31*a*1 and a part of the coil 31*a*2 are formed. For example, a conductive line to be arranged to be closer to the central part 132*a* on the housing surface configures the coil 31*a*2, and a conductive line to be arranged to be closer to the outer peripheral side 130*d* configures the coil 31*a*1. Directions of currents flowing on the conductive lines configuring the coils 31*a*1 and 31*a*2, as indicated by arrows in FIG. 38A, are the same direction in the first and second printed-circuit boards 31*d*1 and 31*d*2, and the current flowing in the conductive line of the first printed-circuit board 31*d*1 and the current flowing in the second printed-circuit board 31*d*2 have opposite directions.

Figure 38B:
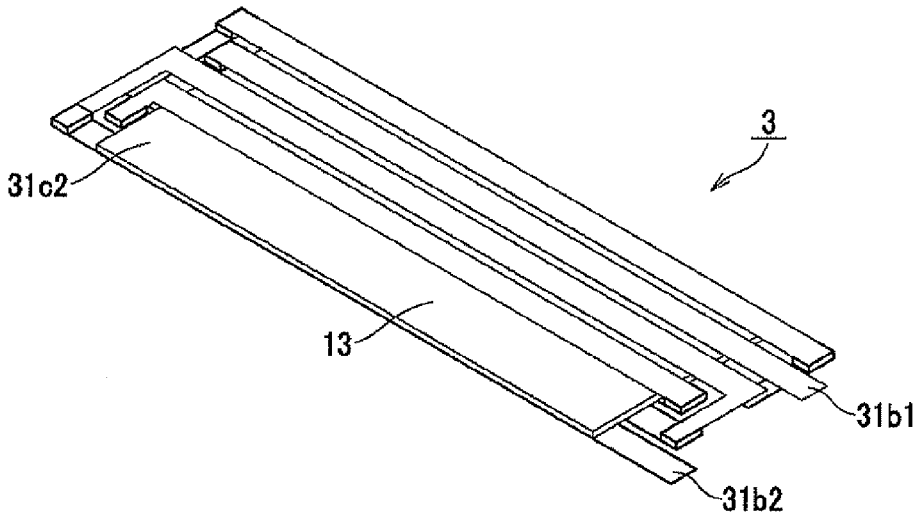

The magnetic sheet 13 is inserted between the first printed-circuit board 31*d*1 and the second printed-circuit board 31*d*2. More specifically, the magnetic sheet 13 is mounted on the upper surface of the positioned second printed-circuit board 31*d*2 such that the magnetic sheet 13 is positioned with respect to a specific position of, for example, the second printed-circuit board 31*d*2. Furthermore, the first printed-circuit board 31*d*1 is positioned and mounted on the positioned second printed-circuit board 31*d*2 and the upper surface of the magnetic sheet 13. Subsequently, as shown in FIG. 38B, the conductive line on the first printed-circuit board 31*d*1 and the conductive line on the second printed-circuit board 31*d*2 are electrically connected to each other to form the first and second coils 31*a*1 and 31*a*2. In FIG. 38B, in order to clearly show the states of the coils 31*a*1 and 31*a*2, the printed-circuit boards 31*d*1 and 31*d*2 are omitted.

Figure 39:
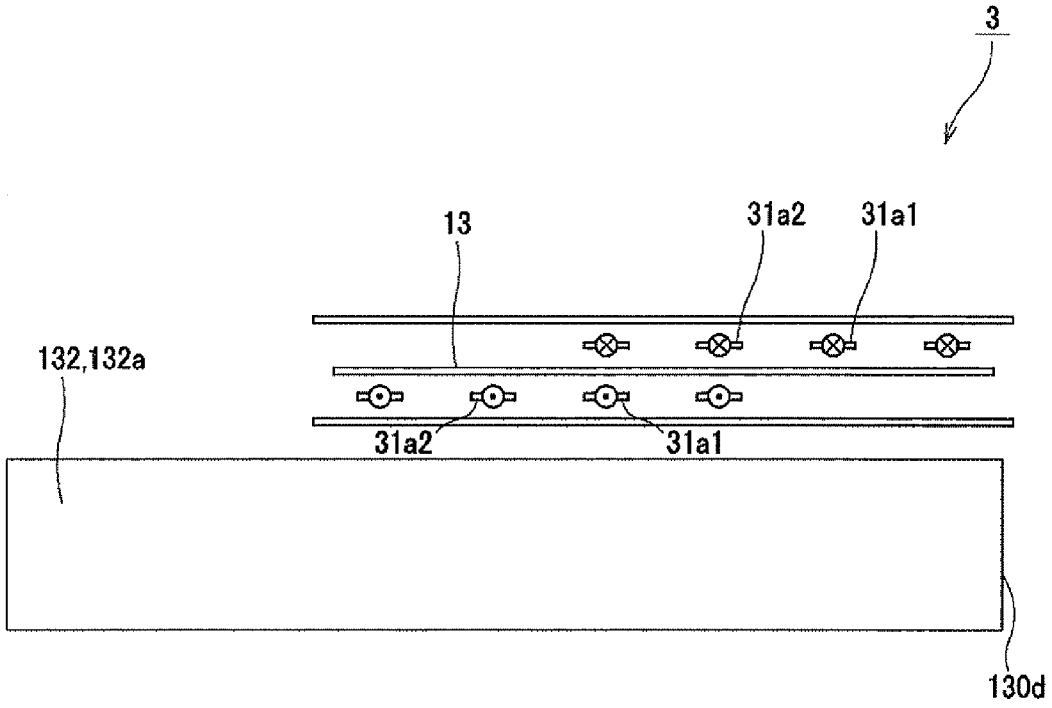
FIG. 39 is a diagram for explaining a configuration of a communication device according to the third embodiment, and is a diagram typically showing a state in which the communication device is mounted on a circuit board of a mobile phone.

As shown in FIG. 39, on the outer peripheral side 130*d* side of the circuit board 132, the conductive line of the first coil 31*a*1 is closer to the reader-writer 120 than the magnetic sheet 13. On the central part 132*a* side, the conductive line of the second coil 31*a*2 is closer to the circuit board 132 side than the magnetic sheet 13. ½ regions of the first coil 31*a*1 and the second coil 31*a*2 can be vertically superimposed on each other. In this manner, a magnetic field from the reader-writer 120 can be efficiently attracted to the magnetic sheet 13, and the communication characteristics can be improved.

Not only a thin magnetic sheet but also a thick magnetic sheet can be used.

The areas of the first and second printed-circuit boards 31*d*1 and 31*d*2 are set to be larger than the area of the magnetic sheet 13 to make it possible to cover the entire area of the magnetic sheet 13 with the first and second printed-circuit boards 31*d*1 and 31*d*2. The flexible plastic material such as polyimide or PET is used as base materials of the first and second printed-circuit boards 31*d*1 and 31*d*2 to make it possible to seal the magnetic sheet 13 in the first and second printed-circuit boards 31*d*1 and 31*d*2. In particular, when a ceramic material such as ferrite is used as a magnetic material, ceramic powder can be prevented from falling when the antenna module according to the present invention is mounted in an electronic device. As the first and second printed-circuit board, a rigid circuit board can be also used as a matter of course. When the antenna module is configured by using the rigid circuit board, a mechanical strength that is higher than that in the flexible printed-circuit board can be obtained.

Another Embodiment

Figure 40A:
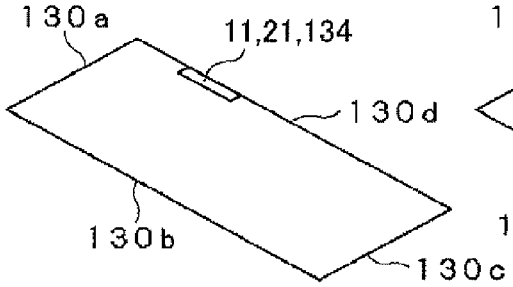
FIG. 40A is a perspective view showing an antenna circuit board arranged on an outer peripheral part on an outer peripheral side 130*d* side.
Figure 40B:
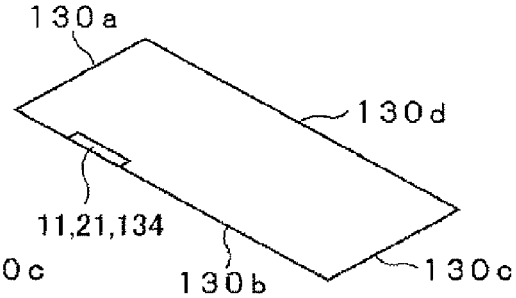
FIG. 40B is a perspective view showing an antenna circuit board arranged on an outer peripheral part on another outer peripheral side 130*b* side.
Figure 40C:
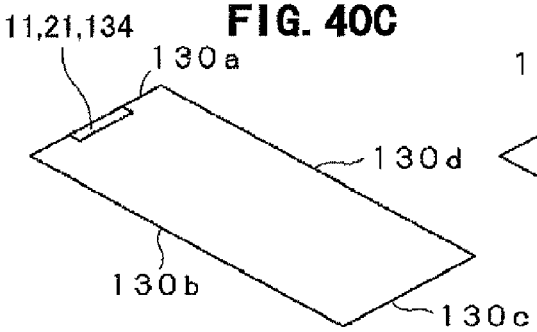
FIG. 40C is a perspective view showing an antenna circuit board arranged on an outer peripheral part on still another outer peripheral side 130*a* side.
Figure 40D:
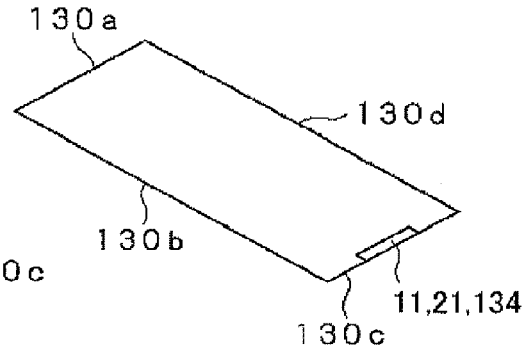
FIG. 40D is a perspective view showing an antenna circuit board arranged on an outer peripheral part on still another outer peripheral side 130*c* side.

In the communication devices 1, 2, and 3 to which the present invention is applied, as shown in FIG. 40A, the antenna circuit boards 11 and 21 need not be arranged on the outer peripheral part 134 on the outer peripheral side 130*d* side of the outer peripheral sides 130*a*, 130*b*, 130*c*, and 130*d* sides, for example, the antenna circuit boards 11 and 21 may be arranged on the outer peripheral part 134 on the outer peripheral side 130*a* side as shown in FIG. 40B, on the outer peripheral part 134 on the outer peripheral side 130*a* side as shown in FIG. 40C, or on the outer peripheral part 134 on the outer peripheral side 130*c* side as shown in FIG. 40D.

Figure 41A:
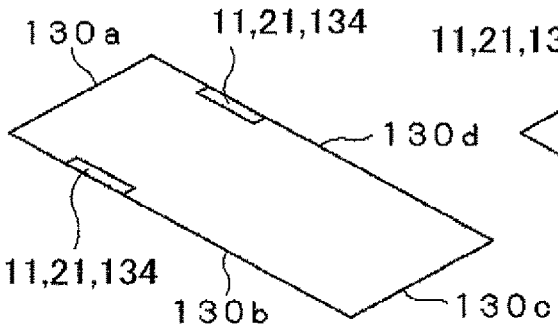
FIG. 41A is a perspective view showing two antenna circuit boards arranged on the outer peripheral parts on the outer peripheral side 130*b* side and the outer peripheral side 130*d* side.
Figure 41B:
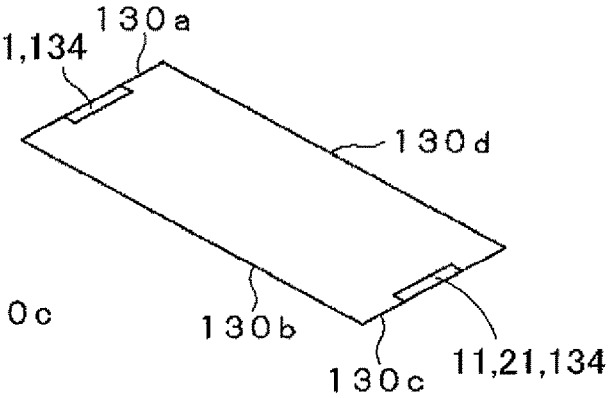
FIG. 41B is a perspective view showing two antenna circuit boards arranged on the outer peripheral parts of the outer peripheral side 130*a* side and the outer peripheral side 130*c* side.

In the communication devices 1, 2, and 3 to which the present invention is applied, are described above, since the area of the antenna coil can be reduced, the plurality of antenna circuit boards 11 and 12 may be arranged. For example, as shown in FIG. 41A, the antenna circuit boards 11 and 21 may be arranged on the outer peripheral parts 134 on the outer peripheral side 130*b* side and the outer peripheral side 130*d* side, respectively, or, as shown in FIG. 41B, the antenna circuit boards 11 and 21 are arranged on the outer peripheral parts 134 on the outer peripheral side 130*a* side and the outer peripheral side 130*c* side, respectively, to electrically connect the antenna coils of the antenna circuit boards 11 and 21 to a communication processing unit.

In the communication devices 1, 2, and 3 to which the present invention is applied, for example, as shown in FIG. 42A, the antenna circuit boards 11 and 21 are arranged on the outer peripheral part 134 on the outer peripheral side 130*a* side, the outer peripheral side 130*b* side, and the outer peripheral side 130*d* side, respectively, or, as shown in FIG. 42B, the antenna circuit boards 11 and 21 may be arranged on the outer peripheral parts 134 on the outer peripheral side 130*a* side, the outer peripheral side 130*c* side, and the outer peripheral side 130*d* side, respectively, to electrically connect the antenna coils of the antenna circuit boards 11 and 21 to the communication processing unit.

In the communication device to which the present invention is applied, for example, as shown in FIG. 43, the antenna circuit boards 11 and 21 may be arranged on the outer peripheral parts 134 on the outer peripheral side 130*a* side, the outer peripheral side 130*b* side, the outer peripheral side 130*c* side, and the outer peripheral side 130*d* side to electrically connect the antenna coils of the antenna circuit boards 11 and 21 to the communication processing unit.

REFERENCE SIGNS LIST

1, 2, 3 . . . communication device, 11, 21 . . . antenna circuit board, 11*a*, 21*a* . . . antenna coil, 11*a*1, 11*a*2, 21*a*1, 21*a*2, 31*a*1, 31*a*2 . . . coil, 11*b*, 21*b*1, 21*b*2, 31*b*1, 31*b*2 . . . terminal unit, 11*c*1, 11*c*2, 22*c*1, 21*c*2 . . . opening, 23 . . . conductive line part, 12 . . . communication processing unit, 13, 133, 213 . . . magnetic sheet, 100 . . . wireless communication system, 121 . . . antenna, 122 . . . control circuit board, 130 . . . mobile phone, 130*a*-130*d* . . . outer peripheral side, 131 . . . housing, 132 . . . circuit board, 132*a* . . . central part, 134 . . . outer peripheral part, 201 . . . communication device, 211 . . . antenna circuit board, 211*a* . . . antenna coil, 211*c* . . . central part, 213 . . . magnetic sheet,

The invention claimed is:

1. An antenna module that is incorporated in an electronic device and becomes communicable in response to a magnetic field transmitted from a transmitter, the antenna module comprising:

an antenna coil that is arranged on an outer peripheral part of a housing surface and is configured to face the transmitter and electromagnetically couple to the transmitter; and a magnetic sheet configured to attract a magnetic field transmitted from the transmitter to the antenna coil, the magnetic sheet being superimposed with the antenna coil in a direction orthogonal to the housing surface such that the magnetic sheet is between the antenna coil and the housing surface on an outer peripheral side and the antenna coil is between the magnetic sheet and the housing surface on a center side;

the antenna coil including:

a first coil having a first conductive line arranged between the magnetic sheet and the housing surface; and a second coil having a second conductive line arranged such that the magnetic sheet is between the second conductive line and the housing surface, the first and second coils being connected in one of a series connection and a parallel connection, the first and second coils being superimposed in the direction orthogonal to the housing surface such that approximately half or less of areas of the first and second coils are superimposed and portions of each of the first and second conductive lines are superimposed.

2. The antenna module according to claim 1, wherein the first and second coils are formed on a printed-circuit board and wound in opposite directions through a connection point, the first coil is arranged to be closer to an outer periphery of the housing surface than the second coil, and the magnetic sheet is inserted into an opening of the first coil, and the second coil is folded such that the second conductive line is folded from a position on the center side to a position where portions of each of the first and second conductive lines are superimposed.

3. The antenna module according to claim 2, wherein the first coil is folded such that on the outer peripheral side, the magnetic sheet is between a conductive line of the first coil and the housing surface.

4. The antenna module according to claim 3, wherein the printed-circuit board has a bent part depending on a thickness of the magnetic sheet.

5. The antenna module according to claim 3, wherein the first coil is folded such that the first conductive line is between the magnetic sheet and the housing surface, and the second coil is folded such that the magnetic sheet is between the second conductive line and the housing surface.

6. The antenna module according to claim 1, wherein the first coil is formed on a first printed-circuit board, the second coil is formed on a second printed-circuit board, the magnetic sheet is laminated between the first printed-circuit board and the second printed-circuit board, and the antenna coil is configured by connecting a conductive line formed on the first printed-circuit board and a conductive line formed on the second printed-circuit board to each other.

7. The antenna module according to claim 1, wherein in the antenna coil, the first coil in which the magnetic sheet is inserted into an opening and the second coil that is arranged to be closer to a center of the housing surface than the first coil and in which the magnetic sheet is inserted into an opening are electrically connected to each other.

8. The antenna module according to claim 7, wherein on the antenna coil, an input/output terminal can connect the first coil and the second coil such that one of the series connection and the parallel connection is selected.

9. The antenna module according to claim 7, wherein the antenna coil is formed by using a conductive line on a printed-circuit board.

10. A communication device that is incorporated in an electronic device and becomes communicable in response to a magnetic field transmitted from a transmitter, the communication device comprising:

an antenna coil that is arranged on an outer peripheral part of a housing surface and is configured to face the transmitter and electromagnetically couple to the transmitter;

a magnetic sheet configured to attract a magnetic field transmitted from the transmitter to the antenna coil, the magnetic sheet being superimposed with the antenna coil in a direction orthogonal to the housing surface such that the magnetic sheet is between the antenna coil and the housing surface on an outer peripheral side and the antenna coil is between the magnetic sheet and the housing surface on a center side; and a communication processing unit that is driven by a current flowing in the antenna coil and is configured to communicate with the transmitter;

the antenna coil including:

a first coil having a first conductive line arranged between the magnetic sheet and the housing surface; and a second coil having a second conductive line arranged such that the magnetic sheet is between the second conductive line and the housing surface, the first and second coils being connected in one of a series connection and a parallel connection, the first and second coils being superimposed in the direction orthogonal to the housing surface such that approximately half or less of areas of the first and second coils are superimposed and portions of each of the first and second conductive lines are superimposed.

11. A method of manufacturing an antenna module that is incorporated in an electronic device and becomes communicable in response to a magnetic field transmitted from a transmitter, the method comprising:

preparing an antenna coil that is arranged on an outer peripheral part of a housing surface and is configured to face the transmitter and electromagnetically couple to the transmitter; and preparing a magnetic sheet configured to attract a magnetic field transmitted from the transmitter to the antenna coil, the magnetic sheet being superimposed with the antenna coil in a direction orthogonal to the housing surface such that the magnetic sheet is between the antenna coil and the housing surface on an outer peripheral side and the antenna coil is between the magnetic sheet and the housing surface on a center side;

the antenna coil including:

a first coil having a first conductive line arranged between the magnetic sheet and the housing surface; and a second coil having a second conductive line arranged such that the magnetic sheet is between the second conductive line and the housing surface, the first and second coils being connected in one of a series connection and a parallel connection, the first and second coils being superimposed in the direction orthogonal to the housing surface such that approximately half or less of areas of the first and second coils are superimposed and portions of each of the first and second conductive lines are superimposed.

12. The method of manufacturing an antenna module according to claim 11, wherein the first and second coils are formed on a printed-circuit board and wound in opposite directions through a connection point, the first coil is arranged to be closer to an outer periphery of the housing surface than the second coil, and the magnetic sheet is inserted into an opening of the first coil, and the second coil is folded such that the second conductive line is folded from a position on the center side to a position where portions of each of the first and second conductive lines are superimposed.

13. The method of manufacturing an antenna module according to claim 11, wherein the first coil is formed on a first printed-circuit board, the second coil is formed on a second printed-circuit board, the magnetic sheet is laminated between the first printed-circuit board and the second printed-circuit board, and the antenna coil is configured by connecting a conductive line formed on the first printed-circuit board and a conductive line formed on the second printed-circuit board to each other.

* * * * *